US005316812A

United States Patent [19]

Stout et al.

[11] Patent Number: 5,316,812

[45] Date of Patent: May 31, 1994

[54] COATED ABRASIVE BACKING

[75] Inventors: George M. Stout, Maplewood; James G. Homan, Eagan; John R. Mlinar, Coon Rapids, all of Minn.; Larry R. Wright, Ames, Iowa

[73] Assignee: Minnesota Mining and Manufacturing Company, St. Paul, Minn.

[21] Appl. No.: 811,547

[22] Filed: Dec. 20, 1991

[51] Int. Cl.[5] ..... B24D 11/00

[52] U.S. Cl. ..... 428/64; 51/293; 51/295; 51/297; 51/298; 51/307; 428/66; 428/143; 428/220; 428/255; 428/325; 428/473.5; 428/474.4

[58] Field of Search ..... 428/64, 66, 220, 143, 428/325, 255, 473.5, 474.4; 51/293, 295, 297, 298, 307

[56] References Cited

U.S. PATENT DOCUMENTS

| | | | |
|---|---|---|---|
| 2,520,763 | 8/1950 | Goepfert et al. | 51/195 |
| 2,534,805 | 12/1950 | Waterfield | 51/297 |
| 3,240,579 | 3/1966 | Ahlbrecht | 51/298 |
| 3,353,308 | 11/1967 | Zane | 51/397 |
| 4,088,729 | 5/1978 | Sherman | 51/298 |
| 4,405,341 | 9/1983 | Jaschek | 51/298 |
| 4,447,208 | 5/1984 | Kawai | 433/166 |
| 4,455,343 | 6/1984 | Temple | 428/285 |
| 4,554,765 | 11/1985 | Grimes et al. | 51/401 |
| 4,774,788 | 10/1988 | Shacham et al. | 51/168 |
| 4,842,619 | 6/1989 | Fritz et al. | 51/295 |
| 4,903,440 | 2/1990 | Larson | 51/298 |
| 5,075,354 | 12/1991 | Mitsuuchi | 524/494 |
| 5,109,638 | 5/1992 | Kime | 51/297 |
| 5,183,479 | 2/1993 | Grimes | 51/293 |

FOREIGN PATENT DOCUMENTS

| | | |
|---|---|---|
| 1469865 | 3/1969 | Fed. Rep. of Germany . |
| 3416186 | 1/1985 | Fed. Rep. of Germany . |
| 2421032 | 10/1979 | France . |
| 701785 | 3/1969 | U.S.S.R. . |
| 2232636 | 12/1990 | United Kingdom . |
| WO90/11171 | 10/1990 | World Int. Prop. O. . |

OTHER PUBLICATIONS

Polyamides, Production, Properties, Processing, and Application, Kunststoff-Handbuch, vol. VI (1966).

*Primary Examiner*—Ellis P. Robinson
*Assistant Examiner*—Nasser Ahmad
*Attorney, Agent, or Firm*—Gary L. Griswold; Walter N. Kirn; Jeffrey L. Wendt

[57] ABSTRACT

The present invention provides a backing for a coated abrasive article, wherein the backing includes a tough, heat resistant, thermoplastic binder material, and an effective amount of a fibrous reinforcing material distributed throughout the thermoplastic binder material. The tough, heat resistant, thermoplastic binder material and the fibrous reinforcing material together form a hardened composition that will not substantially deform or disintegrate during use.

23 Claims, 3 Drawing Sheets

COATED ABRASIVE BACKING

FIELD OF THE INVENTION

The present invention relates to coated abrasive articles. More specifically, the present invention relates to coated abrasive articles with a backing material containing a thermoplastic resin and a fibrous reinforcing material.

BACKGROUND ART

Coated abrasive articles generally contain an abrasive material, typically in the form of abrasive grains, bonded to a backing by means of one or more adhesive layers. Such articles usually take the form of sheets, discs, belts, bands, and the like, which can be adapted to be mounted on pulleys, wheels, or drums. Abrasive articles can be used for sanding, grinding, or polishing various surfaces of, for example, steel and other metals, wood, wood-like laminates, plastic, fiberglass, leather, or ceramics.

Many abrasive articles are used as discs, in grinding assemblies. A typical such abrasive sanding or grinding assembly includes: a back-up pad or support pad made from a resilient and reinforced material such as rubber or plastic; an abrasive disc, which is typically frictionally mounted on the back-up pad; and a rotatable shaft and cap for mounting the abrasive disc and back-up pad by pressure applied to the disc upon screwing the cap into the shaft so that the disc is squeezed against the back-up pad. In use, the shaft of the assembly exemplified is rotated and the abrasive coated surface of the disc is pressed against a workpiece with considerable force. Thus, the disc is subjected to severe stresses. This is also true for abrasive articles in other forms, such as belts.

The backings used in coated abrasive articles are typically made of paper, polymeric materials, cloth, nonwoven materials, vulcanized fiber, or combinations of these materials. Many of these materials are not appropriate for certain applications because they are not of sufficient strength, flexibility, or impact resistance. Some of these materials age unacceptably rapidly. In some instances the materials are sensitive to liquids which are used as coolants and cutting fluids. As a result, early failure and poor functioning can occur in certain applications.

A common material used for coated abrasive backing material is vulcanized fiber. Vulcanized fiber backings are typically heat resistant and strong, which are advantageous characteristics when the coated abrasive is used in a grinding operation that imposes severe conditions of heat and pressure. For example, vulcanized fiber is used in certain grinding operations, such as weld grinding, contour grinding, and edge grinding, wherein the coated abrasive can be exposed to temperatures greater than 140° C. Vulcanized fiber backings, however, are expensive, hygroscopic, and thus sensitive to humidity.

Under extreme conditions of humidity, i.e., conditions of high and low humidity, vulcanized fiber will be affected by either expansion or shrinkage, due, respectively, to water absorption or loss. As a result, an abrasive article made of vulcanized fiber will tend to cup, causing a coated abrasive disc to curl either in a concave or a convex fashion. When this cupping or curling occurs, the affected coated abrasive disc does not lay flat against the back-up pad or support pad. This essentially renders the coated abrasive disc inoperable.

SUMMARY OF THE INVENTION

The coated abrasive articles of the invention can be utilized in relatively severe grinding conditions, without significant deformation or deterioration of the backing. Herein, the phrase "severe grinding conditions" means the temperature at the abrading interface (during grinding) is at least about 200° C., usually at least about 300° C., and the pressure at the abrading interface is at least about 7 kg/cm$^2$, usually at least about 13.4 kg/cm$^2$. The temperature and pressure at the abrading interface of the surface being abraded are instantaneous or localized values experienced by the coated abrasive article at the point of contact between the abrasive grain on the backing and the workpiece, without an external cooling source such as a water spray. Although instantaneous or localized temperatures can be higher than 200° C., and often higher than 300° C., during grinding, the backing will typically experience an overall or equilibrium temperature of less than these values due to thermal dissipation. Of course, the articles can be used in less severe grinding operations, if desired.

The coated abrasive backings of the present invention include a thermoplastic binder material, preferably a tough, heat resistant, thermoplastic binder material; and an effective amount of a fibrous reinforcing material. Preferably, the fibrous reinforcing material is distributed throughout the thermoplastic binder material. The fibrous reinforcing material generally consists of fibers, i.e., fine thread-like pieces with an aspect ratio of at least about 100:1. The binder and the fibrous reinforcing material together form a hardened composition that will not substantially deform or disintegrate during use. Preferably, the "tough, heat resistant" thermoplastic binder material imparts desirable characteristics to the hardened composition such that it will not substantially deform or disintegrate under a variety of abrading, i.e., grinding, conditions. More preferably, the hardened composition of fibrous reinforcing material and tough, heat resistant, thermoplastic binder material will not substantially deform or disintegrate under severe grinding conditions, as defined above.

The backing preferably includes about 60–99% of a thermoplastic binder material, based upon the weight of the backing, with a preferable melting point of at least about 200° C., and an effective amount of a fibrous reinforcing material. Preferably, the hardened composition contains a sufficient amount of thermoplastic binder material such that the backings of the present invention possess a void volume of less than about 0.10%. The thermoplastic material can be selected from the group consisting of polycarbonates, polyetherimides, polyesters, polysulfones, polystyrenes, acrylonitrile-butadiene-styrene block copolymers, acetal polymers, polyamides, and combinations thereof. The most preferred thermoplastic binder material is a polyamide material. The fibrous reinforcing material is preferably in the form of individual fibers or fibrous strands, such as glass fibers. The melting point of the fibrous reinforcing material is preferably at least about 25° C. above the melting point of the thermoplastic binder material.

Preferably, the coated abrasive backings of the present invention include an effective amount of a toughening agent therein. The toughening agent is preferably a rubber toughener or a plasticizer. The toughening agent is more preferably selected from the group consisting of toluenesulfonamide derivatives, styrene butadiene copolymers, polyether backbone polyamides, rubber-polyamide graft copolymers, triblock polymers of styrene-(ethylene butylene)-styrene, and mixtures thereof. Of these toughening agents, rubber-polyamide copolymers and styrene-(ethylene butylene)-styrene triblock polymers are more preferred, with rubber-polyamide copolymers the most preferred.

The hardened binder/fiber compositions that form the coated abrasive backings are preferably flexible, possessing a flexural modulus of at least about 17,500 kg/cm$^2$, more preferably about 17,500–141,000 kg/cm$^2$, under ambient conditions. Herein, the phrase "ambient conditions" and variants thereof refer to room temperature, i.e., 15°–30° C., generally about 20°–25° C., and 30–50% relative humidity, generally about 35–45% relative humidity. The hardened binder/fiber compositions that form the coated abrasive backings also preferably possess a tensile strength of at least about 17.9 kg/cm of width at about 150° C. for a sample thickness of about 0.75–1.0 mm.

The abrasive articles of the present invention include a backing with a working surface, i.e., a front or top surface, on which is coated a first adhesive layer, or make coat. An abrasive material, preferably abrasive grains, which preferably have an average particle size of at least about 0.1 micrometer, and more preferably at least about 100 micrometers, is embedded into the first adhesive layer; and a second adhesive layer, or size coat, typically coats the abrasive material and the first adhesive layer. The first and second adhesive layers each preferably include calcium carbonate filled resole phenolic resin.

The coated abrasive articles of the present invention can, if desired, be made by a method of injection molding. This method includes a step of combining a thermoplastic binder material, a fibrous reinforcing material, and, optionally, a toughening agent. Preferably, the method includes combining a tough, heat resistant, thermoplastic binder material, and a fibrous reinforcing material, such that the fibrous reinforcing material is distributed throughout the binder (more preferably, it is distributed substantially uniformly throughout the binder), and optional toughening agent, to form a softened, moldable, mixture. The method also involves forming a shaped object out of the softened, moldable, mixture; cooling the shaped object to form a hardened backing, of a tough, heat resistant, thermoplastic binder material and a fibrous reinforcing material distributed throughout. The hardened backing can be used as a coated abrasive article that will not substantially deform or disintegrate in use, (preferably under conditions of a temperature at an abrading interface of a surface being abraded of at least about 200° C. and a pressure at the abrading interface of the surface being abraded of at least about 7 kg/cm$^2$). The process further includes the steps of applying a layer of an adhesive to the hardened backing; and applying a layer of abrasive material to the hardened backing coated with a layer of adhesive.

Advantageously, and preferably, the step of combining a tough, heat resistant, thermoplastic binder material, preferably a polyamide, and a fibrous reinforcing material, preferably glass fibers, includes forming pellets out of the softened moldable mixture of the thermoplastic binder material and the fibrous reinforcing material. The method can also include, preferably and advantageously, a step of adding a toughening agent to the thermoplastic binder material and the fibrous reinforcing material prior to the step of forming a shaped object.

BRIEF DESCRIPTION OF THE DRAWING

FIG. 1 is schematic in nature to reflect construction according to the present invention.

DETAILED DESCRIPTION

As required, detailed descriptions of the present invention are provided herein. In general, the detailed descriptions are to be considered as exemplary only. Therefore, the invention is not to be interpreted as limited to the specific formulations, arrangements, and methods identified and described, except as limited by the claims.

FIGS. 1-4

Figure 2:
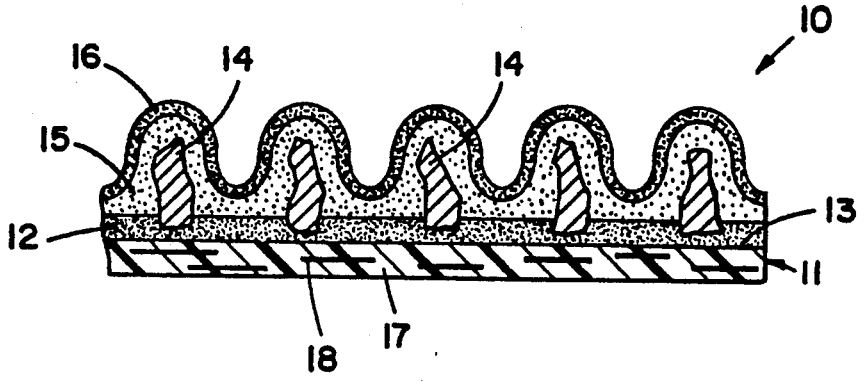
FIG. 2 is an enlarged fragmentary side cross-sectional view of a coated abrasive article according to the present invention, taken along line 2—2, FIG. 1.
Figure 1:
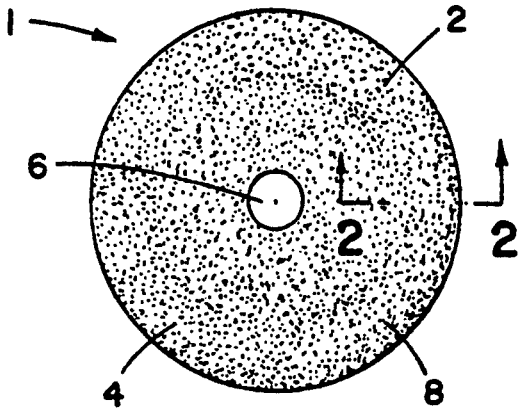
FIG. 1 is a front view of a coated abrasive article according to the present invention.

In FIG. 1, a front View of a circular disc 1 is shown, which incorporates the construction of FIG. 2. Circular disc 1 is representative of a working surface 2 of a coated abrasive disc according to the present invention. Herein, the working surface 2 is also referred to as a front surface or a top surface, and generally represents the surface used for abrading workpieces. The representation shows two general regions 4 and 6. Region 4 includes abrasive material in the form of abrasive grains 8 adhered to the working surface 2 of the backing of the circular disc 1. Region is a center hole in the circular disc 1 for use in mounting on a rotatable shaft of a grinding apparatus.

Generally, the diameter of the disc will be within the size range of about 6–60 centimeters (cm). Preferably, the disc diameter is about 11–30 cm, and more preferably about 17–23 cm. Many commonly used discs are in the size range of about 17–23 cm in diameter. The disc will also typically have a center hole, i.e., region 6 in FIG. 1, which is usually about 2–3 cm in diameter.

Referring to FIG. 2, in general, a coated abrasive article 10 according to the present invention includes: a backing 11; and a first adhesive layer 12, which is commonly referred to as a make coat, applied to a working surface 13 of the backing 11. The purpose of the first adhesive layer 12 is to secure an abrasive material, such as a plurality of abrasive grains 14, to the working surface 13 of the backing 11.

Referring to FIG. 2, a second adhesive layer 15, which is commonly referred to as a size coat, is coated over the abrasive grains 14 and the first adhesive layer 12. The purpose of the size coat is to securely anchor the abrasive grains 14. A third adhesive layer 16, which is commonly referred to as a supersize coat, may be coated over the second adhesive layer 15. The third adhesive layer 16 is optional and is typically utilized in coated abrasives that abrade very hard surfaces, such as stainless steel or exotic metal workpieces.

The thickness of the backing 11 is typically less than about 1.5 millimeter (mm) for optimum flexibility, and material conservation. Preferably, the thickness of the backing 11 is between about 0.5 and 1.2 mm for optimum flexibility. More preferably, the thickness of the backing 11 is between about 0.7 and 1.0 mm.

Referring to FIG. 2, the structure of the backing 11 consists of a thermoplastic binder material 17 and a fibrous reinforcing material 18. The fibrous reinforcing material 18 can be in the form of individual fibers or strands, or in the form of a fiber mat or web. Whether the fibrous reinforcing material 18 is in the form of individual fibers or a mat, the fibrous reinforcing material 18 is preferably distributed throughout the thermoplastic binder material 17 in the body of the backing. More preferably, this distribution is substantially uniform throughout the body of the backing 11. That is, the fibrous reinforcing material is not merely applied to a surface of the body of the backing, or within separate layers of the backing. Rather, the fibrous reinforcing material is substantially completely within the internal structure of, and distributed throughout, the backing. Of course, a fibrous mat or web structure could be of sufficient dimensions to be distributed throughout the backing binder.

Any of the backing configurations of the present invention provide advantageous strength, wear resistance, and other improved characteristics to the coated abrasive backings of the present invention. Whether the fibrous reinforcing material is in the form of individual fibers, or in the form of a mat or web structure, if it is distributed throughout the thermoplastic binder material in the backing, and more preferably distributed uniformly throughout the backing binder, specific advantage is realized, particularly with respect to the strength and wear characteristics.

Although FIGS. 1 and 2 are representative of a coated abrasive disc, the present invention may be applied to constructions having other shapes and forms as well. The coated abrasive articles of the present invention can possess a wide variety of backing shapes depending upon the end uses of the coated abrasive articles. For example, the backing can be tapered so that the center portion of the backing is thicker than the outer portions. The backing can have a uniform thickness. The backing can be embossed. The center of the backing can be depressed, or lower, than the outer portions. The backing shape can also be square, rectangular, octagonal, circular, in the form of a belt, or in any other geometric form. The edges of the backing can be purposely bent to make a "cupped" disc if so desired. The edges of the backing can also be smooth or scalloped.

The backing may preferably have a series of ribs, i.e., alternating thick and thin portions, molded into the backing for further advantage when desired for certain applications. The molded-in ribs can be used for designing in a required stiffness or "feel during use" (using finite element analysis), improved cooling, improved structural integrity, and increased torque transmission when the ribs interlock with a back-up pad. These ribs can be straight or curved, radial, concentric circles, random patterns, or combinations thereof.

Figure 3:
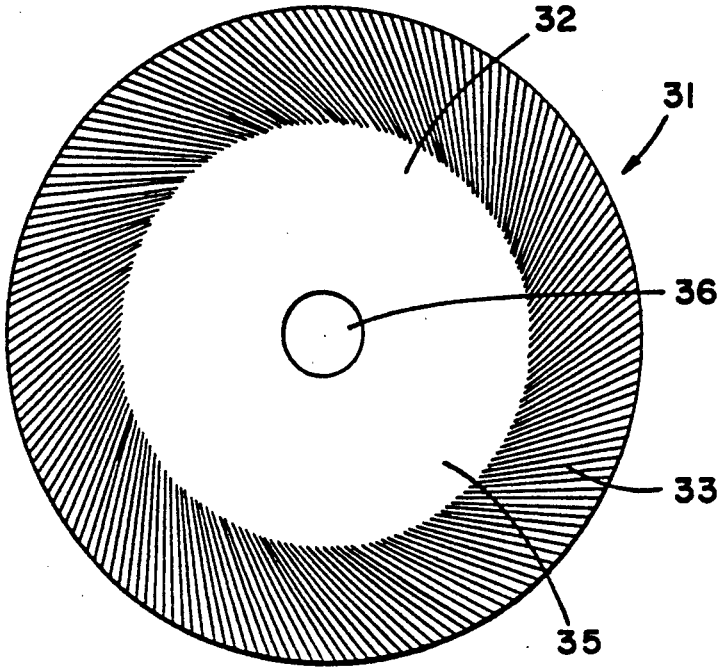
FIG. 3 is a back view of a coated abrasive article showing ribs molded into the backing.

In FIG. 3, a back view of a circular disc 3 is shown. Circular disc 31 is representative of a coated abrasive disc with a series of radial ribs 33 molded into the backing material. This view represents a back surface 32 of the disc 31, which is the surface of the disc opposite that shown in FIG. 1. That is, back surface 32 is the surface on which there is typically no abrasive material. Thus, the surface of the backing on which the abrasive material is coated is generally flat, i.e., without ridges or ribs. Although this particular embodiment shows the ribs 3 extending only partially to a center hole 36, leaving a region 35 in which there are no molded-in ribs, the ribs 33 could extend along the entire back surface 32 to the center hole 36, if so desired.

The molded-in ribs can be at any angle relative to a radius of the disc. That is, the ribs can be disposed at an angle relative to a radius, i.e., a line segment extending from the center of the disc to the outer edge, that is within a range of 0–90°. The ribs can also be disposed in a pattern having variable angles relative to the radius, to maximize air flow.

Figure 4:
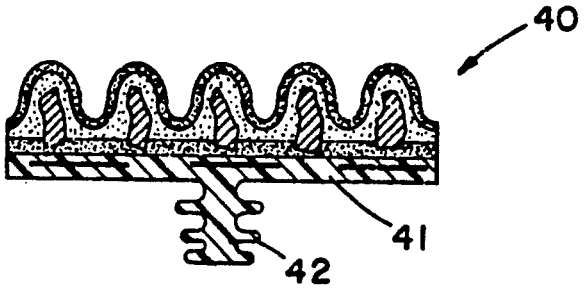
FIG. 4 is an enlarged fragmentary side cross-sectional view of a second embodiment of a coated abrasive article in the form of a disc with an attachment system according to the present invention, taken generally analogously to FIG. 2 but incorporating said attachment system.

Additionally, an attachment system to secure the coated abrasive to a tool and/or an adaptor to a tool, can be molded directly into the backing. Referring to FIG. 4, the coated abrasive 40 has a backing 41 and an attachment system 42. The attachment system 42 and the backing 41 are unitary and integral, i.e., one continuous (molded) structure. This type of attachment system is further illustrated in U.S. Pat. No. 3,562,968, the disclosure of which is incorporated herein by reference. Typically, if the attachment system is a molded-in attachment system, i.e., molded directly into the backing, then the diameter of the backing will be less than about 12 cm, and preferably less than about 8 cm. Furthermore, the attachment will also preferably consist of a hardened composition of thermoplastic binder material and an effective amount of fibrous reinforcing material distributed throughout the thermoplastic binder material. Such an integral attachment system is advantageous at least because of the ease and certainty of mounting a backing in the center of a hub. That is, if the backing is in the shape of a disc, the attachment system can be located in the geometric center of the disc thereby allowing for centering easily on the hub.

The backings of the present invention may also have alternative three-dimensional molded shapes, which can provide advantage. Referring to an alternative design of a coated abrasive article 60 shown in FIG. 6, a backing 61 in the form of a disc has a raised edge region 62. The raised edge region 62 is a region of greater thickness in the backing 61 at an outer edge region 63 of the disc relative to the center region 65 of the disc. Preferably, the raised edge region 62 generally represents an increased thickness in the backing of about $2\text{–}3\times10^{-2}$ cm relative to the thickness in the center region 65. The raised edge region 62 can be of any width. Preferably, the raised edge region 62 of backing 61 represents a 3.5–5.5 cm ring at the outer edge region 63 of the disc backing 61. Typically, and preferably, the raised edge region 62 is the only region of the backing 61 that is coated with abrasive material 66 and adhesive layers 67, 68, and 69. This embodiment thus has a raised ring-shaped region around the outer portion of a disc that is coated with abrasive material. Because there is generally no need to have abrasive material coated on the surface of the center region 65 of the disc, discs with this shape are typically more economical. Although this embodiment is in the shape of a disc, a raised edge region on which is coated abrasive material can be incorporated into a coated abrasive article of any shape.

Preferably, discs of the present invention may also possess depressed center regions. As seen in the embodiment shown in FIG. 6, the backing 61 of a disc is molded into a shape with a depressed center region 65. This can be done for specific advantage. For example, a disc made with a depressed center region 65 is desirable if a retainer nut, i.e., a nut for fastening the disc to a back-up pad, is to be recessed. Furthermore, such a shape can be more stable under a variety of conditions of temperature and humidity.

Figure 6:
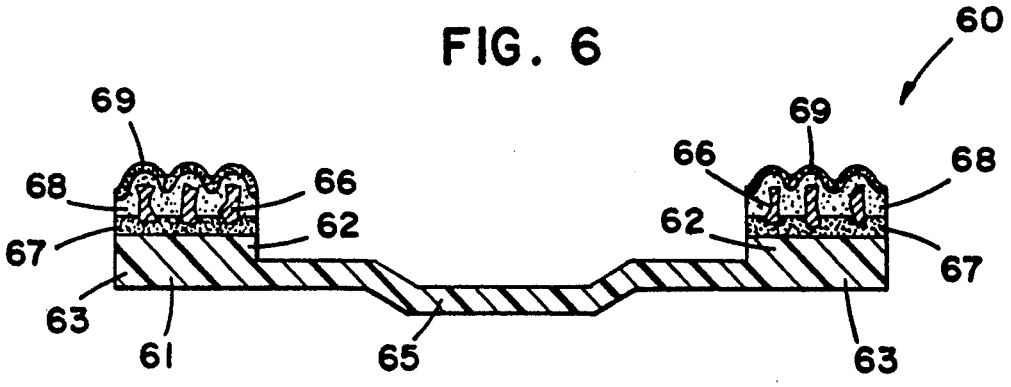
FIG. 6 is an enlarged fragmentary side cross-sectional view of another embodiment of a coated abrasive article in the form of a disc according to the present invention, taken generally analogously to FIG. 2 but extending across the entire diameter of the disc, and slightly offset from the middle such that a center hole (analogous to region 6, FIG. 1) is not shown.
Figure 7:
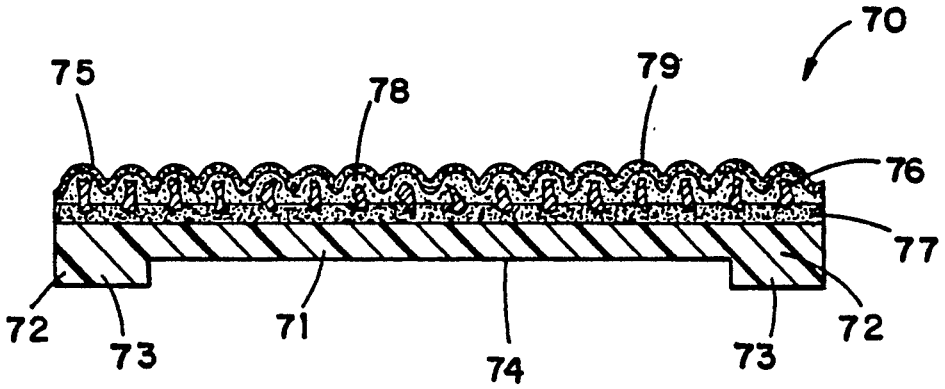
FIG. 7 is an enlarged fragmentary side cross-sectional view of another embodiment of a coated abrasive article in the form of a disc according to the present invention, taken generally analogously to FIG. 2 but extending across the entire diameter of the disc, and slightly offset from the middle such that a center hole (analogous to region 6, FIG. 1) is not shown.

Preferably and advantageously, backings of the present invention can have edges of increased thickness for added stiffness. As shown in FIG. 6, this can result in an article with raised edges on which abrasive material is coated. Alternatively, as shown in a disc 70 in FIG. 7, backing 71 has a molded-in edge region 72 of increased thickness at the outer edge region 73 of the disc 70. The edge region 72 represents a very small surface area relative to the overall surface area of the disc 70, and protrudes away from the abrasive surface 75 of the disc 70, i.e., the surface that contacts the workpiece. Edge region 72, which is in the form of a ring of greater thickness at the outer edge region 73 of the backing 71, relative to a center region 74 of the backing, imparts increased stiffness such that the disc can withstand greater stress before warping. In contrast to the embodiment shown in FIG. 6, that shown in FIG. 7 has abrasive material 76 and adhesive layers 77, 78, and 79 coated on the surface opposite the surface with the raised edge region 72. That is, the raised edge of the disc shown in FIG. 7 would protrude from the back surface of the backing away from the abraded article during use, whereas the raised edge of the disc shown in FIG. 6 would protrude from the working surface of the backing toward the abraded article during use.

It is also envisioned that words which describe various product designations and descriptions can be formed into the back surface of the backing of the abrasive articles of the present invention if so desired. Furthermore, the backings of the present invention can have perforations, i.e., holes in the backing. Such holes would provide dust control by providing a means by which the abraded material can be removed during use from between the workpiece and the abrasive article.

Backing

The preferred coated abrasive articles of the present invention generally include a backing with the following properties. The backing is sufficiently tough and heat resistent under severe grinding conditions such that the backing does not significantly disintegrate or deform from the heat generated during a grinding, sanding, or polishing operation. Preferably, the backing will operably withstand a temperature at the abrading interface of a workpiece of at least about 200° C., preferably at least about 300° C. The phrase "at the abrading interface" in the context of temperature and pressure refers to the instantaneous or localized temperature and pressure the backing experiences at the contact point between the abrasive material on the article and the workpiece. Thus, the equilibrium or overall temperature of the backing would typically be less than the instantaneous or localized temperature at a contact point between the coated abrasive on the article and the workpiece during operation. Backings that withstand these conditions also typically withstand the temperatures used in the curing of the adhesive layers of a coated abrasive article without disintegration or deformation.

The backing is sufficiently tough such that it will not significantly crack or shatter from the forces encountered during grinding, preferably under severe grinding conditions. That is, the backing will preferably operably withstand use in a grinding operation conducted with a pressure at the abrading interface of a workpiece of at least about 7 kg/cm$^2$, preferably at least about 13.4 kg/cm$^2$.

A preferred backing of the present invention exhibits sufficient flexibility to withstand typical grinding conditions and preferably severe grinding conditions. By "sufficient flexibility" it is meant that the backing will bend and return to its original shape without significant permanent deformation. That is, for preferred grinding operations, a "flexible" backing is one that is sufficiently capable of flexing and adapting to the contour of the workpiece being abraded without permanent deformation of the backing, yet is sufficiently strong to transmit an effective grinding force when pressed against the workpiece.

Preferably, the backing possesses a flexural modulus of at least about 17,500 kg/cm$^2$ under ambient conditions, with a sample size of 25.4 mm (width)$\times$50.8 mm (span across the jig)$\times$0.8–1.0 mm (thickness), and a rate of displacement of 4.8 mm/min, as determined by following the procedure outlined in American Society for Testing and Materials (ASTM) D790 test method, which is incorporated herein by reference. More preferably, the backing possesses a flexural modulus of between about 17,500 kg/cm$^2$ and about 141,000 kg/cm$^2$. A backing with a flexural modulus less than about 17,500 kg/cm$^2$ would generally be insufficiently stiff to controllably abrade the surface of the workpiece. A backing with a flexural modulus greater than about 141,000 kg/cm$^2$ would generally be too stiff to sufficiently conform to the surface of the workpiece.

Briefly, ASTM D790 test method involves the use of either a three-point loading system utilizing center loading by means of a loading nose, which has a cylindrical surface, midway between two supports, each of which have a cylindrical surface; or a four-point loading system utilizing two load points equally spaced from their adjacent support points, with a distance between load points of either one-third or one-half of the support span. The specimen is deflected until rupture occurs or until the maximum strain has reached 0.05 mm/mm, i.e., a 5% deflection. The flexural modulus, i.e., tangent modulus of elasticity, is determined by the initial slope of the load vs. deflection curve.

A preferred backing of the present invention also exhibits sufficient flexural toughness to withstand severe grinding conditions. By "sufficient flexural toughness" it is meant that the backing will be sufficiently stiff to withstand severe grinding conditions, but not undesirably brittle such that cracks are formed in the backing, thereby decreasing its structural integrity. This can be demonstrated by subjecting the backing, or coated abrasive article, to an Angle Iron Test, which is described in the Example Section.

Briefly, the Angle Iron Test involves: making a coated abrasive article; flexing the coated abrasive article, e.g., a disc, such that the adhesive layers are broken thereby creating small islands of noninteracting abrasive; storing the coated abrasive disc in a humidity chamber for 3 days at 45% relative humidity; installing the coated abrasive disc on a hard phenolic back-up pad smaller in diameter than the disc such that about 7–8 cm of the outer periphery of the coated abrasive disc is unsupported by the back-up pad; securing the coated abrasive disc/back-up pad to an air grinder capable of rotating at a speed of 4,500 revolutions per minute (rpm) with air pressure of 2.3 kg/cm$^2$; holding the coated abrasive disc/back-up pad at a 40° angle and forcing it into a 140° wedge or "V" of a V-shaped workpiece under a constant load of 2–6 kg, preferably 2–3 kg; sweeping the coated abrasive disc/back-up pad across the length of the workpiece for about 0.75 m in one direction in about 15 seconds; sweeping the coated abrasive disk/back-up pad across the 0.75 m length of the workpiece in the opposite direction in about 15 seconds. The sample disc is swept across the workpiece continuously for either 10–15 minutes or until the coated abrasive backing "fails," whichever takes the least amount of time.

"Failure" in the context of the Angle Iron Test is determined by disintegration, i.e., loss of structural integrity, of the backing, which can result from tearing, buckling, or snagging. Disintegration can also be measured by the development of edge cracks in the backing of the coated abrasive article tested. If, during the Angle Iron Test, the backing of the coated abrasive article develops surface cracks greater than about 0.6 cm in length, or otherwise loses structural integrity, within a 2 minute test period, the backing is considered to be unacceptable, i.e., to not have sufficient flexural toughness to withstand severe grinding conditions as defined above. A coated abrasive article "passes" the angle iron test, i.e., is of an acceptable flexural toughness quality, if it can grind for at least about 2 minutes without developing such cracks, or otherwise losing structural integrity.

Figure 5:
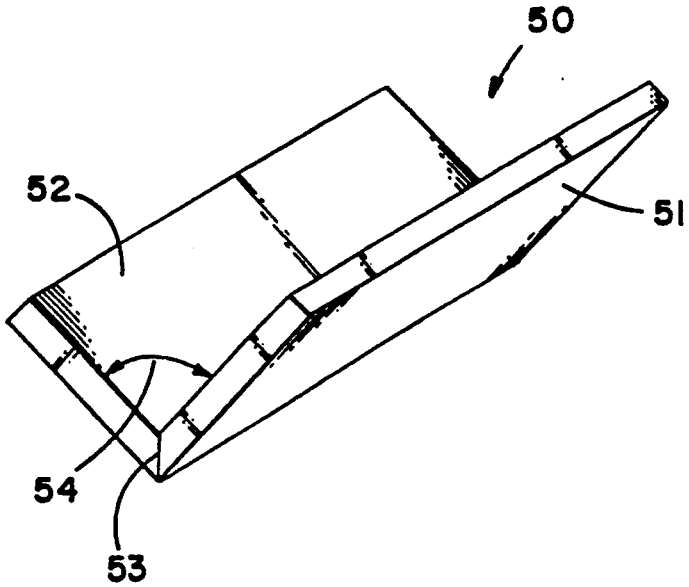
FIG. 5 is a perspective view of a workpiece used for an angle iron test, described herein.

FIG. 5 illustrates the workpiece for the Angle Iron Test. The workpiece 50 for this test includes two pieces, 51 and 52, of 1018 mild steel (0.77 mm long and 2.54 cm thick) welded together at interface 53 to form a V-shape such that there is approximately a 140° angle 54 between the two pieces of 1018 mild steel 51 and 52.

If heat resistant adhesive layers, i.e., the make and size coats, are not used, if an effective abrasive grain for abrading 1018 steel is not used, or if the proper size of an abrasive grain is not used, then the coated construction can fail the Angle Iron Test. This failure would not be attributed to the backing; rather the failure would be attributed to the improper make or size coats, the improper abrasive grain, or the improper abrasive grain particle size. Failure could also be attributed to the improper cure of the make or size coats, or improper or inadequate flexing prior to testing. Flexing of coated abrasive articles is typically done under controlled manufacturing conditions. By passing the articles between weighted rollers, for example, the adhesive layers are uniformly and directionally cracked, i.e., broken such that there are small islands of noninterconnected abrasive material, while there are no cracks in the backing formed. This procedure typically improves the flexibility of the coated abrasive articles.

The desirable toughness of the backing of the present invention can also be demonstrated by measuring the impact strength of the coated abrasive backing. The impact strength can be measured by following the test procedures outlined in ASTM D256 or D3029 test methods, which are incorporated herein by reference. These methods involve a determination of the force required to break a standard test specimen of a specified size. The backings of the present invention preferably have an impact strength, i.e., a Gardner Impact value, of at least about 0.4 Joules for a 0.89 mm thick sample under ambient conditions. More preferably, the backings of the present invention have a Gardner Impact value of at least about 0.9 Joules, and most preferably at least about 1.6 Joules, for a 0.89 mm thick sample under ambient conditions.

A preferred backing of the present invention also has desirable tensile strength. Tensile strength is a measure of the greatest longitudinal stress a substance can withstand without tearing apart. It demonstrates the resistance to rotational failure and "snagging" as a result of high resistance at discontinuities in the workpiece that a coated abrasive article might contact during operation. The test procedure is described in the Example Section. A desirable tensile strength is defined as at least about 17.9 kg/cm of width at about 150° C. for a sample thickness of about 0.75–1.0 mm.

A preferred backing of the present invention also exhibits appropriate shape control and is sufficiently insensitive to environmental conditions, such as humidity and temperature. By this it is meant that preferred coated abrasive backings of the present invention possess the above-listed properties under a wide range of environmental conditions. Preferably, the backings possess the above-listed properties within a temperature range of about 10–30° C., and a humidity range of about 30–50% relative humidity (RH). More preferably, the backings possess the above-listed properties under a wide range of temperatures, i.e., from below 0° C. to above 100° C., and a wide range of humidity values, from below 10% RH to above 90% RH.

Under extreme conditions of humidity, i.e., conditions of high humidity (greater than about 90% RH) and low humidity (less than about 10% RH), the backing of the present invention will not be significantly affected by either expansion or shrinkage due, respectively, to water absorption or loss. As a result, an abrasive article made with a backing of the present invention will not significantly deform, e.g., cup or curl in either a concave or a convex fashion.

The preferred backing material used in coated abrasive articles of the present invention is generally chosen such that there will be compatibility with, and good adhesion to, the adhesive layers, particularly to the make coat. Good adhesion is determined by the amount of "shelling" of the abrasive material. Shelling is a term used in the abrasive industry to describe the undesired, premature release of the abrasive material, typically in the form of abrasive grains, from the backing. The preferred backing of the present invention displays a shelling of no more than about 6 grams of the abrasive material from a 7 inch diameter disc coated with a grade 24 abrasive grain (American National Standards Institute Standard B74.18-1984), under conditions of the Edge Shelling Test, which is described in detail in the Example Section. Although the choice of backing material is important, the amount of shelling typically depends to a greater extent on the choice of adhesive and the compatibility of the backing and adhesive materials.

Briefly, the Edge Shelling Test involves: attaching an article with a coated abrasive surface, e.g., a disc, to a hard phenolic back-up pad; mounting the coated abrasive disc/back-up pad on a steel flange; rotating the coated abrasive disc/back-up pad at a rate of 3,550 rpm; rotating a steel workpiece at 2 rpm; contacting the abrasive surface of the coated abrasive disc and the workpiece under a load of 2.1 kg; abrading the surface of the workpiece for a period of 8 minutes; and measuring the amount of steel cut or abraded from the workpiece, and the amount of abrasive grain loss from the abrasive coated article.

The workpiece used in the Edge Shelling Test is the peripheral edge (1.6 mm) of a 25 cm diameter 4130 mild steel disc, oriented at an 18.5° angle from a position normal to the abrasive disc. The workpiece is weighed before and after the 8 minute test to determine the amount of metal cut or abraded from the workpiece. Additionally, the abrasive disc is weighed before and after the 8 minute test to determine how much material is lost during use. The ideal coated abrasive article provides a low abrasive grain loss weight and a relatively high steel cut. A steel cut of 125 grams or more is acceptable, for example, for a 7-inch diameter disc coated with a grade 24 abrasive grain (American National Standards Institute Standard B74.18-1984).

The coated abrasive articles of the present invention include a backing, which contains a thermoplastic binder material and an effective amount of a fibrous reinforcing material. By an "effective amount" of a fibrous reinforcing material, it is meant that the backing contains a sufficient amount of the fibrous reinforcing material to impart at least improvement in heat resistance, toughness, flexibility, stiffness, shape control, adhesion, etc., discussed above.

Preferably, the amount of the thermoplastic binder material in the backing is within a range of about 60–99%, more preferably within a range of about 65–95%, and most preferably within a range of about 70–85%, based upon the weight of the backing. The remainder of the typical, preferred backing is primarily a fibrous reinforcing material with few, if any, voids throughout the hardened backing composition. Although there can be additional components added to the binder composition, a coated abrasive backing of the present invention primarily contains a thermoplastic binder material and an effective amount of a fibrous reinforcing material.

Typically, the higher the content of the reinforcing material, the stronger the backing will be; however, if there is not a sufficient amount of binder, then the adhesion to the make coat, i.e., the first adhesive layer, may be deficient. Furthermore, if there is too much fibrous reinforcing material, the backing can be too brittle for desired applications. By proper choice of thermoplastic binder material and fibrous reinforcing material, such as, for example, a polyamide thermoplastic binder and glass reinforcing fiber, considerably higher levels of the binder can be employed to produce a hardened backing composition with few if any voids and with the properties as described above.

Preferably, the hardened backing composition possesses a void volume of less than about 0.10%. Herein "void volume" means a volume within a backing of the present invention filled with air or gas, i.e., absent solid material. The percent void volume can be determined by comparing the actual density (mass/volume) of the hardened backing composition to the total calculated density of the various components. That is, the percent void volume equals [1−(actual density/calculated density)]×100.

Backing Binder

The preferred binder in the backing of the coated abrasive articles of the present invention is a thermoplastic material. A thermoplastic binder material is defined as a polymeric material (preferably, an organic polymeric material) that softens and melts when exposed to elevated temperatures and generally returns to its original condition, i.e., its original physical state, when cooled to ambient temperatures. During the manufacturing process, the thermoplastic binder material is heated above its softening temperature, and preferably above its melting temperature, to cause it to flow and form the desired shape of the coated abrasive backing. After the backing is formed, the thermoplastic binder is cooled and solidified. In this way the thermoplastic binder material can be molded into various shapes and sizes.

Thermoplastic materials are preferred over other types of polymeric materials at least because the product has advantageous properties, and the manufacturing process for the preparation of backings is more efficient. For example, a backing formed from a thermoplastic material is generally less brittle and less hygroscopic than a backing formed from a thermosetting material. Furthermore, as compared to a process that would use a thermosetting resin, a process that uses a thermoplastic material requires fewer processing steps, fewer organic solvents, and fewer materials, e.g., catalysts. Also, with a thermoplastic material, standard molding techniques such as injection molding can be used to form the backing. This can reduce the amount of materials wasted in construction, relative to conventional "web" processes.

In a typical web manufacturing process, a coated abrasive article is made in a continuous web form and then converted into a desired shape, such as a sheet, disc, or belt, upon cutting. Although it is preferable to use injection molding techniques to produce backings for the coated abrasive articles of the present invention to avoid waste, this is not intended to mean that conventional "web" processes cannot be used.

Preferred moldable thermoplastic materials of the invention are those having a high melting temperature, good heat resistant properties, and good toughness properties such that the hardened backing composition containing these materials operably withstands abrading conditions without substantially deforming or disintegrating. The toughness of the thermoplastic material can be measured by impact strength. Preferably, the thermoplastic material has a Gardner Impact value of at least about 0.4 Joules for a 0.89 mm thick sample under ambient conditions. More preferably, the "tough" thermoplastic material used in the backings of the present invention have a Gardner Impact value of at least about 0.9 Joules, and most preferably at least about 1.6 Joules, for a 0.89 mm thick sample under ambient conditions.

Preferred hardened backing compositions withstand a temperature of at least about 200° C., preferably at least about 300° C., and a pressure of at least about 7 $kg/cm^2$, preferably at least about 13.4 $kg/cm^2$, at the abrading interface of a workpiece. That is, the preferred moldable thermoplastic materials have a melting point of at least about 200° C., preferably at least about 220° C. Additionally, the melting temperature of the tough, heat resistant, thermoplastic material is preferably sufficiently lower, i.e., at least about 25° C. lower, than the melting temperature of the fibrous reinforcing material. In this way, the reinforcing material is not adversely affected during the molding of the thermoplastic binder. Furthermore, the thermoplastic material in the backing is sufficiently compatible with the material used in the adhesive layers such that the backing does not deteriorate, and such that there is effective adherence of the abrasive material. Preferred thermoplastic materials are also generally insoluble in an aqueous environment, at least because of the desire to use the coated abrasive articles of the present invention on wet surfaces.

Examples of thermoplastic materials suitable for preparations of backings in articles according to the present invention include polycarbonates, polyetherimides, polyesters, polysulfones, polystyrenes, acrylonitrile-butadiene-styrene block copolymers, acetal polymers, polyamides, or combinations thereof. Of this list, polyamides and polyesters are preferred. Polyamide materials are the most preferred thermoplastic binder materials, at least because they are inherently tough and heat resistant, typically provide good adhesion to the preferred adhesive resins without priming, and are relatively inexpensive.

If the thermoplastic binder material from which the backing is formed is a polycarbonate, polyetherimide, polyester, polysulfone, or polystyrene material, use of a primer may be preferred to enhance the adhesion between the backing and the make coat. The term "primer" as used in this context is meant to include both mechanical and chemical type primers or priming processes. Examples of mechanical priming processes include, but are not limited to, corona treatment and scuffing, both of which increase the surface area of the backing. An example of a preferred chemical primer is a colloidal dispersion of, for example, polyurethane, acetone, isopropanol, water, and a colloidal oxide of silicon, as taught by U.S. Pat. No. 4,906,523, which is incorporated herein by reference.

The most preferred thermoplastic material from which the backing of the present invention is formed is a polyamide resin material, which is characterized by having an amide group, i.e., —C(O)NH—. Various types of polyamide resin materials, i.e., nylons, can be used, such as nylon 6/6 or nylon 6. Of these, nylon 6 is most preferred if a phenolic-based make coat, i.e., first adhesive layer, is used. This is because excellent adhesion can be obtained between nylon 6 and phenolic-based adhesives.

Nylon 6/6 is a condensation product of adipic acid and hexamethylenediamine. Nylon 6/6 has a melting point of about 264° C. and a tensile strength of about 770 kg/cm$^2$. Nylon 6 is a polymer of ε-caprolactam. Nylon 6 has a melting point of about 223° C. and a tensile strength of about 700 kg/cm$^2$.

Examples of commercially available nylon resins useable as backings in articles according o the present invention include "Vydyne" from Monsanto, St. Louis, Mo.; "Zytel" and "Minlon" both from DuPont, Wilmington, Del.; "Trogamid T" from Huls America, Inc., Piscataway, N.J.; "Capron" from Allied Chemical Corp., Morristown, N.J.; "Nydur" from Mobay, Inc., Pittsburgh, Pa.; and "Ultramid" from BASF Corp., Parsippany, N.J. Although a mineral-filled thermoplastic material can be used, such as the mineral-filled nylon 6 resin "Minlon," the mineral therein is not characterized as a "fiber" or "fibrous material," as defined herein; rather, the mineral is in the form of particles, which possess an aspect ratio typically below 100:1.

Reinforcing Material

Besides the thermoplastic binder material, the backing of the invention includes an effective amount of a fibrous reinforcing material. Herein, an "effective amount" of a fibrous reinforcing material is a sufficient amount to impart at least improvement in the physical characteristics of the hardened backing, i.e., heat resistance, toughness, flexibility, stiffness, shape control, adhesion, etc., but not so much fibrous reinforcing material as to give rise to any significant number of voids and detrimentally affect the structural integrity of the backing. Preferably, the amount of the fibrous reinforcing material in the backing is within a range of about 1–40%, more preferably within a range of about 5–35%, and most preferably within a range of about 15–30%, based upon the weight of the backing.

The fibrous reinforcing material can be in the form of individual fibers or fibrous strands, or in the form of a fiber mat or web. Preferably, the reinforcing material is in the form of individual fibers or fibrous strands for advantageous manufacture. Fibers are typically defined as fine thread-like pieces with an aspect ratio of at least about 100:1. The aspect ratio of a fiber is the ratio of the longer dimension of the fiber to the shorter dimension. The mat or web can be either in a woven or nonwoven matrix form. A nonwoven mat is a matrix of a random distribution of fibers made by bonding or entangling fibers by mechanical, thermal, or chemical means.

Examples of useful reinforcing fibers in applications of the present invention include metallic fibers or nonmetallic fibers. The nonmetallic fibers include glass fibers, carbon fibers, mineral fibers, synthetic or natural fibers formed of heat resistant organic materials, or fibers made from ceramic materials. Preferred fibers for applications of the present invention include nonmetallic fibers, and more preferred fibers include heat resistant organic fibers, glass fibers, or ceramic fibers.

By "heat resistant" organic fibers, it is meant that useable organic fibers must be resistant to melting, or otherwise breaking down, under the conditions of manufacture and use of the coated abrasive backings of the present invention. Examples of useful natural organic fibers include wool, silk, cotton, or cellulose. Examples of useful synthetic organic fibers include polyvinyl alcohol fibers, polyester fibers, rayon fibers, polyamide fibers, acrylic fibers, aramid fibers, or phenolic fibers. The preferred organic fiber for applications of the present invention is aramid fiber. Such fiber is commercially available from the Dupont Co., Wilmington, Del. under the trade names of "Kevlar" and "Nomex."

Generally, any ceramic fiber is useful in applications of the present invention. An example of a ceramic fiber suitable for the present invention is "Nextel" which is commercially available from 3M Co., St. Paul, Minn.

The most preferred reinforcing fibers for applications of the present invention are glass fibers, at least because they impart desirable characteristics to the coated abrasive articles and are relatively inexpensive. Furthermore, suitable interfacial binding agents exist to enhance adhesion of glass fibers to thermoplastic materials. Glass fibers are typically classified using a letter grade. For example, E glass (for electrical) and S glass (for strength). Letter codes also designate diameter ranges, for example, size "D" represents a filament of diameter of about 6 micrometers and size "G" represents a filament of diameter of about 10 micrometers. Useful grades of glass fibers include both E glass and S glass of filament designations D through U. Preferred grades of glass fibers include E glass of filament designation "G" and S glass of filament designation "G." Commercially available glass fibers are available from Specialty Glass Inc., Oldsmar, Fla.; Owens-Corning Fiberglass Corp., Toledo, Ohio; and Mo-Sci Corporation, Rolla, Mo.

If glass fibers are used, it is preferred that the glass fibers are accompanied by an interfacial binding agent, i.e., a coupling agent, such as a silane coupling agent, to improve the adhesion to the thermoplastic material. Examples of silane coupling agents include "Z-6020" and "Z-6040," available from Dow Corning Corp., Midland, Mich.

Advantages can be obtained through use of fiber materials of a length as short as 100 micrometers, or as long as needed for one continuous fiber. Preferably, the length of the fiber will range from about 0.5 mm to about 50 mm, more preferably from about 1 mm to about 25 mm, and most preferably from about 1.5 mm to about 10 mm. The reinforcing fiber denier, i.e., degree of fineness, for preferred fibers ranges from about 1 to about 5000 denier, typically between about 1 and about 1000 denier. More preferably, the fiber denier will be between about 5 and about 300, and most preferably between about 5 and about 200. It is understood that the denier is strongly influenced by the particular type of reinforcing fiber employed.

The reinforcing fiber is preferably distributed throughout the thermoplastic material, i.e., throughout the body of the backing, rather than merely embedded in the surface of the thermoplastic material. This is for the purpose of imparting improved strength and wear characteristics throughout the body of the backing. A construction wherein the fibrous reinforcing material is distributed throughout the thermoplastic binder material of the backing body can be made using either individual fibers or strands, or a fibrous mat or web structure of dimensions substantially equivalent to the dimensions of the finished backing. Although in this preferred embodiment distinct regions of the backing may not have fibrous reinforcing material therein, it is preferred that the fibrous reinforcing material be distributed substantially uniformly throughout the backing.

The fibrous reinforcing material can be oriented as desired for advantageous applications of the present invention. That is, the fibers can be randomly distributed, or they can be oriented to extend along a direction desired for imparting improved strength and wear characteristics. Typically, if orientation is desired, the fibers should generally extend transverse (±20°) to the direction across which a tear is to be avoided.

Toughening Agent

The backings of the present invention can further include an effective amount of a toughening agent. This will be preferred for certain applications. A primary purpose of the toughening agent is to increase the impact strength of the coated abrasive backing. By "an effective amount of a toughening agent" it is meant that the toughening agent is present in an amount to impart at least improvement in the backing toughness without it becoming too flexible. The backings of the present invention preferably include sufficient toughening agent to achieve the desirable impact test values listed above.

Typically, a preferred backing of the present invention will contain between about 1% and about 30% of the toughening agent, based upon the total weight of the backing. More preferably, the toughening agent, i.e., toughener, is present in an amount of about 5–15 wt-%. The amount of toughener present in a backing may vary depending upon the particular toughener employed. For example, the less elastomeric characteristics a toughening agent possesses, the larger quantity of the toughening agent may be required to impart desirable properties to the backings of the present invention.

Preferred toughening agents that impart desirable stiffness characteristics to the backing of the present invention include rubber-type polymers and plasticizers. Of these, the more preferred are rubber toughening agents, most preferably synthetic elastomers.

Examples of preferred toughening agents, i.e., rubber tougheners and plasticizers, include: toluenesulfonamide derivatives (such as a mixture of N-butyl- and N-ethyl-p-toluenesulfonamide, commercially available from Akzo Chemicals, Chicago, Ill., under the trade designation "Ketjenflex 8"); styrene butadiene copolymers; polyether backbone polyamides (commercially available from Atochem, Glen Rock, N.J., under the trade designation "Pebax"); rubber-polyamide copolymers (commercially available from DuPont, Wilmington, Del., under the trade designation "Zytel FN"); and functionalized triblock polymers of styrene-(ethylene butylene)-styrene (commercially available from Shell Chemical Co., Houston, Tex., under the trade designation "Kraton FG1901"); and mixtures of these materials. Of this group, rubber-polyamide copolymers and styrene-(ethylene butylene)-styrene triblock polymers are more preferred, at least because of the beneficial characteristics they impart to backings and the manufacturing process of the present invention. Rubber-polyamide copolymers are the most preferred, at least because of the beneficial impact and grinding characteristics they impart to the backings of the present invention.

If the backing is made by injection molding, typically the toughener is added as a dry blend of toughener pellets with the other components. The process usually involves tumble-blending pellets of toughener with pellets of fiber-containing thermoplastic material. A more preferred method involves compounding the thermoplastic material, reinforcing fibers, and toughener together in a suitable extruder, pelletizing this blend, then feeding these prepared pellets into the injection molding machine. Commercial compositions of toughener and thermoplastic material are available, for example, under the designation "Ultramid" from BASF Corp., Parsippany, N.J. Specifically, "Ultramid B3ZG6" is a nylon resin containing a toughening agent and glass fibers that is useful in the present invention.

Optional Backing Additives

Besides the materials described above, the backing of the invention can include effective amounts of other materials or components depending upon the end properties desired. For example, the backing can include a shape stabilizer, i.e., a thermoplastic polymer with a melting point higher than that described above for the thermoplastic binder material. Suitable shape stabilizers include, but are not limited to, poly(phenylene sulfide), polyimides, and polyaramids. An example of a preferred shape stabilizer is polyphenylene oxide nylon blend commercially available from General Electric, Pittsfield, Mass., under the trade designation "Noryl GTX 910." If a phenolic-based make coat and size coat are employed in the coated abrasive construction, however, the polyphenylene oxide nylon blend is not preferred because of nonuniform interaction between the phenolic resin adhesive layers and the nylon, resulting in reversal of the shape-stabilizing effect. This nonuniform interaction results from a difficulty in obtaining uniform blends of the polyphenylene oxide and the nylon.

Other such materials that can be added to the backing for certain applications of the present invention include inorganic or organic fillers. Inorganic fillers are also known as mineral fillers. A filler is defined as a particulate material, typically having a particle size less than about 100 micrometers, preferably less than about 50 micrometers. Examples of useful fillers for applications of the present invention include carbon black, calcium carbonate, silica, calcium metasilicate, cryolite, phenolic fillers, or polyvinyl alcohol fillers. If a filler is used, it is theorized that the filler fills in between the reinforcing fibers and may prevent crack propagation through the backing. Typically, a filler would not be used in an amount greater than about 20%, based on the weight of the backing. Preferably, at least an effective amount of filler is used. Herein, the term "effective amount" in this context refers to an amount sufficient to fill but not significantly reduce the tensile strength of the hardened backing.

Other useful materials or components that can be added to the backing for certain applications of the present invention include, but are not limited to, pigments, oils, antistatic agents, flame retardants, heat stabilizers, ultraviolet stabilizers, internal lubricants, antioxidants, and processing aids. One would not typically use more of these components than needed for desired results.

Adhesive Layers

The adhesive layers in the coated abrasive articles of the present invention are formed from a resinous adhesive. Each of the layers can be formed from the same or different resinous adhesives. Useful resinous adhesives are those that are compatible with the thermoplastic material of the backing. The resinous adhesive is also tolerant of severe grinding conditions, as defined herein, when cured such that the adhesive layers do not deteriorate and prematurely release the abrasive material.

The resinous adhesive is preferably a layer of a thermosetting resin. Examples of useable thermosetting resinous adhesives suitable for this invention include, without limitation, phenolic resins, aminoplast resins, urethane resins, epoxy resins, acrylate resins, acrylated isocyanurate resins, ureaformaldehyde resins, isocyanurate resins, acrylated urethane resins, acrylated epoxy resins, or mixtures thereof.

Preferably, the thermosetting resin adhesive layers contain a phenolic resin, an aminoplast resin, or combinations thereof. The phenolic resin is preferably a resole phenolic resin. Examples of commercially available phenolic resins include "Varcum" from OxyChem, Inc., Dallas, Tex.; "Arofene" from Ashland Chemical Company, Columbus, Ohio; and "Bakelite" from Union Carbide, Danbury, Conn. A preferred aminoplast resin is one having at least 1.1 pendant $\alpha,\beta$-unsaturated carbonyl groups per molecule, which is made according to the disclosure of U.S. Pat. No. 4,903,440, which is incorporated herein by reference.

The first and second adhesive layers, referred to in FIG. 2 as adhesive layers 12 and 15, i.e., the make and size coats, can preferably contain other materials that are commonly utilized in abrasive articles. These materials, referred to as additives, include grinding aids, coupling agents, wetting agents, dyes, pigments, plasticizers, release agents, or combinations thereof. One would not typically use more of these materials than needed for desired results. Fillers might also be used as additives in the first and second adhesive layers. For both economy and advantageous results, fillers are typically present in no more than an amount of about 50% for the make coat or about 70% for the size coat, based upon the weight of the adhesive. Examples of useful fillers include silicon compounds, such as silica flour, e.g., powdered silica of particle size 4–10 mm (available from Akzo Chemie America, Chicago, Ill.), and calcium salts, such as calcium carbonate and calcium metasilicate (available as "Wollastokup" and "Wollastonite" from Nyco Company, Willsboro, N.Y.).

The third adhesive layer 16, FIG. 2, i.e., the supersize coat, can preferably include a grinding aid, to enhance the abrading characteristics of the coated abrasive. Examples of grinding aids include potassium tetrafluoroborate, cryolite, ammonium cryolite, and sulfur. One would not typically use more of a grinding aid than needed for desired results.

Preferably, the adhesive layers, at least the first and second adhesive layers, are formed from a conventional calcium salt filled resin, such as a resole phenolic resin, for example. Resole phenolic resins are preferred at least because of their heat tolerance, relatively low moisture sensitivity, high hardness, and low cost. More preferably, the adhesive layers include about 45–55% calcium carbonate or calcium metasilicate in a resole phenolic resin. Most preferably, the adhesive layers include about 50% calcium carbonate filler, and about 50% resole phenolic resin, aminoplast resin, or a combination thereof. Herein, these percentages are based on the weight of the adhesive.

Abrasive Material

Examples of abrasive material suitable for applications of the present invention include fused aluminum oxide, heat treated aluminum oxide, ceramic aluminum oxide, silicon carbide, alumina zirconia, garnet, diamond, cubic boron nitride, or mixtures thereof. The term "abrasive material" encompasses abrasive grains, agglomerates, or multi-grain abrasive granules. An example of such agglomerates is described in U.S. Pat. No. 4,652,275, which is incorporated herein by reference.

A preferred abrasive material is an alumina-based, i.e., aluminum oxide-based, abrasive grain. Useful aluminum oxide grains for applications of the present invention include fused aluminum oxides, heat treated aluminum oxides, and ceramic aluminum oxides. Examples of useful ceramic aluminum oxides are disclosed in U.S. Pat. Nos. 4,314,827, 4,744,802, and 4,770,671, which are incorporated herein by reference.

The average particle size of the abrasive grain for advantageous applications of the present invention is at least about 0.1 micrometer, preferably at least about 100 micrometers. A grain size of about 100 micrometers corresponds approximately to a coated abrasive grade 120 abrasive grain, according to American National Standards Institute (ANSI) Standard B74.18-1984. The abrasive material can be oriented, or it can be applied to the backing without orientation, depending upon the desired end use of the coated abrasive backing.

Preparation of the Coated Abrasive Articles

A variety of methods can be used to prepare abrasive articles and the backings according to the present invention. It is an advantage that many of the preferred compositions (or components) can be used to form a backing by injection molding. Thus, precise control over manufacture conditions and shape of product is readily obtained, without undue experimentation. The actual conditions under which the backing of the invention is injection molded depends on the type and model of the injection molder employed.

Typically, the components forming the backing are first heated to about 200°-400° C., preferably to about 250°-300° C., i.e., a temperature sufficient for flow. The barrel temperature is typically about 200°-350° C., preferably about 260°-280° C. The temperature of the actual mold is about 50°-150° C., preferably about 90°-110° C. The cycle time will range between about 0.5 and about 30 seconds, preferably the cycle time is about 1 second. From an economic viewpoint, faster cycle times are preferred.

There are various alternative and acceptable methods of injection molding the coated abrasive backings of the present invention. For example, the fibrous reinforcing material, e.g., reinforcing fibers, can be blended with the thermoplastic material prior to the injection molding step. This can be accomplished by blending the fibers and thermoplastic in a heated extruder and extruding pellets.

If this method is used, the reinforcing fiber size or length will typically range from about 0.5 mm to about 50 mm, preferably from about 1 mm to about 25 mm, and more preferably from about 1.5 mm to about 10 mm. Using this method, longer fibers tend to become sheared or chopped into smaller fibers during the processing. If the backing is composed of other components or materials in addition to the thermoplastic binder and reinforcing fibers, they can be mixed with the pellets prior to being fed into the injection molding machine. As a result of this method, the components forming the backing are preferably substantially uniformly distributed throughout the binder in the backing.

Alternatively, a woven mat, a nonwoven mat, or a stitchbonded mat of the reinforcing fiber can be placed into the mold. The thermoplastic material and any optional components can be injection molded to fill the spaces between the reinforcing fibers in the mat. In this aspect of the invention, the reinforcing fibers can be readily oriented in a desired direction. Additionally, the reinforcing fibers can be continuous fibers with a length determined by the size and shape of the mold and/or article to be formed.

In certain situations, a conventional mold release can be applied to the mold for advantageous processing. If, however, the thermoplastic material is nylon, then the mold typically does not have to be coated with a mold release.

After the backing is injection molded, then the make coat, abrasive grains, and size coat are typically applied by conventional techniques. For example, the adhesive layers, i.e., make and size coats, can be coated onto the backing using roll coating, curtain coating, spray coating, brush coating, or any other method appropriate for coating fluids. They can be hardened, e.g., cured, simultaneously or separately by any of a variety of methods. The abrasive grains can be deposited by a gravity feed or they can be electrostatically deposited on the adhesive coated backing by electrically charging the abrasive grains and applying an opposite charge to the backing.

Alternatively, the components forming the backing can be extruded into a sheet or a web form, coated uniformly with binder and abrasive grains, and subsequently converted into abrasive articles, as is done in conventional abrasive article manufacture. The sheet or web can be cut into individual sheets or discs by such means as die cutting, knife cutting, water jet cutting, or laser cutting. The shapes and dimensions of these sheets and/or discs can be those described above in the injection molding description. Next, the make coat, abrasive grains, and size coat can be applied by conventional techniques, such as roll coating of the adhesives and electrostatic deposition of the grains, to form a coated abrasive article.

Alternatively, the backing can remain in the form of a sheet or a web and the make coat, abrasive grains, and size coat can be applied to the backing in any conventional manner. Next, the coated abrasive article can be die cut or converted into its final desired shape or form. If the coated abrasive article is die cut, the shapes and dimensions of these sheets and/or discs can be those described above in the injection molding description. It is also within the scope of certain applications of this invention, that the coated abrasive article can be converted into an endless belt by conventional splicing or joining techniques.

Additionally, two or more layers can be extruded at one time to form the backing of the invention. For example, through the use of two conventional extruders fitted to a two-layer film die, two-layer backings can be formed in which one layer provides improved adhesion for the binder and abrasive grains, while the other layer may contain, for example, a higher level of filler, thereby decreasing the cost without sacrificing performance.

EXAMPLES

The present invention will be further described by reference to the following detailed examples.

General Information

The amounts of material deposited on the backing are reported in grams/square meter (g/m$^2$), although these amounts are referred to as weights; all ratios are based upon these weights. The following designations are used throughout the examples.

N6B: a nylon 6 thermoplastic resin, commercially available from the BASF Company under the trade designation "Ultramid B3F."

MFN6: a mineral-filled nylon 6 thermoplastic resin, commercially available from the DuPont Company under the trade designation "Minlon."

PPO66: a poly(2,6-dimethyl-1,4-phenylene oxide)/nylon 6,6 blend, commercially available from the General Electric Company under the trade designation "Noryl GTX-910."

EFG: diameter G, standard E type continuous stranding glass fibers, available from RTP, Winona, Minn., compounded with nylon 6 or nylon 6,6 resin. In all the examples using "EFG" fibers, the glass fibers and the nylon resin were blended together and extruded into pellets. The length of the pellets was approximately 0.32 cm long. The weights in the following examples denote the actual weight of the glass fibers and the actual weight of the nylon.

EFGL: diameter G, standard E type continuous stranding glass fibers available from ICI, Wilmington, Del., compounded with nylon 6 or nylon 6,6. These glass fibers were saturated with molten nylon polymer, pulled through a forming die of circular cross-section, and chopped into pellets that were 1.3 cm in length. The weights in the following examples denote the actual weight of the glass fibers and the actual weight of the nylon.

SBS: a styrene-(ethylene butylene)-styrene block copolymer toughening agent, commercially available from the Shell Chemical Company under the trade designation "Kraton FG1901."

NTS: a plasticizer, which is primarily a mixture of N-butyl and N-ethyl (p-toluenesulfonamide), commercially available from Akzo Chemicals under the trade designation "Ketjenflex 8."

RP: a base-catalyzed resole phenolic resin with a formaldehyde:phenol ratio of between about 1.5:1 and about 3:1.

BAM: an aminoplast resin with at least 1.1 pendant $\alpha,\beta$-unsaturated carbonyl groups. The resin was prepared similar to Preparation 2 disclosed in U.S. Pat. No. 4,903,440, which is incorporated herein by reference. Briefly, this method involves preparing N,N'-oxydimethylenebisacrylamide ether from N-(hydroxymethyl)acrylamide using 37% aqueous formaldehyde, acrylamide, 91% paraformaldehyde, and p-toluenesulfonic acid hydrate.

PH1: 2,2-dimethoxy-1,2-diphenyl-1-ethanone.

CACO: a powdered, untreated, calcium carbonate filler of particle size 4–20 mm, available from Aluchem Inc., Cincinnati, Ohio.

CMS: a calcium metasilicate filler, commercially available from the Nyco Company, Willsboro, N.Y., under the trade designation "Wollastokup."

CRY: a white powder grade cryolite grinding aid, available from Kaiser Chemicals, Cleveland, Ohio.

GENERAL PROCEDURE FOR INJECTION MOLDING A BACKING

The general procedure for making a backing using injection molding is as follows. The components used in the backing were initially dried for 4 hours at 80° C. The nylon thermoplastic resin was in the form of pellets. The fibers were contained in the pellets. The toughening agent was also in pellet form, except for NTS, which was precompounded into the thermoplastic polymer prior to injection molding. The components were weighed and charged into a five gallon bucket. A blade mixer was inserted into the bucket and the bucket was rotated to thoroughly mix the components while the blade mixer remained stationary. The resulting mixture was then dropped into the barrel of a 300 ton injection molding machine made by Van Dorn. There were three temperature zones in the barrel of the injection molding machine. The first zone was at a temperature of about 265° C., the second zone was at a temperature of about 270° C., and the third zone was at a temperature of about 288° C. The nozzle, i.e., barrel, in the injection molding machine was at a temperature of about 270° C. and the mold was at a temperature of about 93° C. The injection time was about 1 second. The screw speed was slow, i.e., less than 100 revolutions per minute (rpm). The injection pressure was 100 kg/cm$^2$. The injection velocity was about 0.025 meter/-second. The shot size was about 23 cm$^3$. The components were injection molded into the shape of a disc with a diameter of 17.8 cm, a thickness of 0.84 mm, and a center hole diameter of 2.2 cm.

EDGE SHELLING TEST

The Edge Shelling Test measures the amount of 4130 mild steel cut or abraded from a workpiece and amount of abrasive grain loss from the abrasive coated article. The abrasive grain loss corresponds to the amount of "shelling," i.e., the premature release of the abrasive grains from the backing. The coated abrasive disc (17.8 cm in diameter with a 2.2 cm center hole) of each example was attached to a hard phenolic back-up pad with a diameter of 16.5 cm and a maximum thickness of 1.5 cm. The back-up pad was in turn mounted on a 15.2 cm diameter steel flange. The coated abrasive disc was rotated at a rate of 3,550 rpm. The workpiece was the peripheral edge (1.6 mm) of a 25 cm diameter 4130 mild steel disc, oriented at an 18.5° angle from a position normal to the abrasive disc. The workpiece was rotated at 2 rpm, and was placed in contact with the abrasive surface of the coated abrasive disc under a load of 2.1 kg. The pressure at the grinding interface was on the order of approximately 28 kg/cm$^2$. The test endpoint was 8 minutes. At the end of the test, the workpiece was weighed to determine the amount of metal cut or abraded from the workpiece. Additionally the abrasive discs were weighed before and after testing to determine how much material was lost during use. The ideal coated abrasive article provided a low abrasive grain loss weight and a high cut. All the weights were given in grams.

SLIDE ACTION TEST I

This test, as well as Slide Action Tests II and III, were developed to provide a determination of "worst case" performance. Each test was progressively more severe. The same type of back-up pad was used in all three tests to reduce variability. The coated abrasive disc (17.8 cm diameter with a 2.2 cm center hole) of each example was attached to an aluminum plate as the back-up pad (diameter of 16.5 cm, maximum thickness of 1.5 cm). The coated abrasive was then installed on an air grinder which rotated at 6,000 rpm. The workpiece was a 304 stainless steel block (2.54 cm wide by 17.8 cm long). The rotating coated abrasive disc was held stationary and the workpiece reciprocated underneath the disc in a back and forth manner. There was approximately 6.8 kg of force at the grinding interface. The grinding was continuous until either the coated abrasive article failed or 20 minutes of grinding had elapsed, whichever was shorter. "Failure" occurred when the article lost structural integrity, i.e., tore, buckled, or snagged. The amount of stainless steel abraded during the test was also calculated.

SLIDE ACTION TEST II

The procedure for the Slide Action Test II was identical to the procedure for the Slide Action Test I except for the following changes. The workpiece was a 1018 mild steel block (2.54 cm wide by 17.8 cm long). There was approximately 9.1 kg of force at the grinding interface.

SLIDE ACTION TEST III

The procedure for the Slide Action Test III was identical to the procedure for the Slide Action Test II except that the workpiece was a 304 stainless steel block (2.54 cm wide by 17.8 cm long). This test is extremely severe. These grinding conditions are not typical of commercial grinding conditions.

TENSILE TEST

The backing of each example was die cut or slit into a test piece 2.54 cm wide by 17.8 cm long. Each test piece was free of adhesive coatings, e.g., make coat and size coat, and abrasive grain. Each test piece was then installed to a gauge length of 12.7 cm on an Instron Testing Machine and pulled at 0.51 cm/min until 5% elongation was achieved, and 5.1 cm/min thereafter, to measure the tensile strength, which is the maximum force needed to break a test piece. The tensile strength was measured at room temperature and at 150° C. In some examples, the test piece was die cut in the "machine direction" or "cross direction" of the backings. For the injection molded backings, the machine direction samples were die cut along a direction parallel to the flow of the components during the injection molding process, nd the cross direction samples were die cut along a direction perpendicular to the flow of the components during the injection molding process. In some examples an average tensile measurement was recorded which was an average of the machine and cross tensile values.

ANGLE IRON TEST

Coated abrasive disc samples (17.8 cm in diameter and 0.76–0.86 millimeters thick with a 2.2 cm diameter center hole) were first flexed, i.e., the abrasive/adhesive coatings were uniformly and directionally cracked, and then laid flat in a humidity chamber for 3 days at 45% relative humidity, unless otherwise specified. The coated abrasive was then installed on a hard phenolic back-up pad which was 10.2 cm in diameter and a maximum thickness of 1.5 cm. This resulted in the edge of the coated abrasive disc being unsupported by the back-up pad. Each coated abrasive disc/back-up pad was then secured to an air grinder that rotated at 4,500 rpm. The air pressure to the grinder was 2.3 kg/cm$^2$. The air grinder was installed on a Cincinnati Milacron type T3 industrial robot, and was part of the constant load and leveler on the robot arm. The constant load was about 2.3 kg. The workpiece for this test included two pieces of 1018 mild steel welded together to form a V-shape workpiece such that there was approximately a 140° angle between the two pieces. Each piece of steel was 0.77 m long and 2.54 cm thick. This type of workpiece is illustrated in FIG. 5. The coated abrasive disc was held at a 40° angle and was forced into the 140° wedge or V as it was swept back and forth across the length of the workpiece. The sample disc was swept across the workpiece at a rate such that it took approximately 15 seconds for the coated abrasive disc to move across 0.75 m of the length of the workpiece in one direction. The grinding was continuous and only terminated at the end of the test. The test endpoint was generally either 15 minutes or the point at which the coated abrasive backing lost structural integrity, i.e., tore, buckled, snagged, or developed edge cracks greater than 0.6 cm in length, and "failed," whichever occurred first. Typically, if the backing of the coated abrasive article developed edge cracks greater than about 0.6 cm in length or lost structural integrity within a 2 minute test period, the backing was unacceptable. A coated abrasive article "passed" the Angle Iron Test, i.e., was of an acceptable quality, if it could grind for at least about 2 minutes without developing such cracks or losing structural integrity.

EXAMPLES 1 THROUGH 28 AND CONTROL EXAMPLES A THROUGH C

This set of examples demonstrate Various ratios of the components forming the backing of the invention.

CONTROL EXAMPLE A

The coated abrasive for Control Example A was a grade 24 "Paint Buster" fiber disc commercially available from the 3M Company, St. Paul, Minn.

CONTROL EXAMPLE B

The coated abrasive for Control Example B was a grade 24 "Green Corp" fiber disc commercially available from the 3M Company, St. Paul, Minn.

CONTROL EXAMPLE C

The coated abrasive for Control Example C was made in the same manner as Examples 1 through 16 except that the backing was a conventional 0.84 mm thick vulcanized fiber backing.

EXAMPLES 1 THROUGH 28

The ratios of the various components forming the backing of the invention are outlined in Table 1. The backing was made according to the "General Procedure for Injection Molding the Backing" outlined above. Discs from each formulation, i.e., each of the examples, were then used in coated abrasive constructions.

TABLE 1

| Example | N6B | PPO66 | EFG | SBS |
|---|---|---|---|---|
| 1 and 17 | 70 | 10 | 15 | 5 |
| 2 and 18 | 60 | 25 | 10 | 5 |
| 3 and 19 | 70 | 10 | 15 | 5 |
| 4 and 20 | 60 | 5 | 20 | 15 |
| 5 and 21 | 60 | 5 | 30 | 5 |
| 6 and 22 | 70 | 10 | 15 | 5 |
| 7 and 23 | 70 | 5 | 10 | 15 |
| 8 and 24 | 80 | 5 | 10 | 5 |
| 9 and 25 | 70 | 10 | 15 | 5 |
| 10 and 26 | 60 | 15 | 10 | 15 |
| 11 and 27 | 53 | 7 | 35 | 5 |
| 12 and 28 | 70 | 10 | 15 | 5 |
| 13 | 67 | 4 | 26 | 3 |
| 14 | 76 | 6 | 16 | 2 |
| 15 | 75 | 3 | 20 | 2 |
| 16 | 80 | 3.1 | 15 | 1.8 |

EXAMPLES 1 THROUGH 16

The make coat was applied by brush to the side of the backing with a weight of 434 g/m$^2$. The make coat consisted of an 84% solids blend of 48% RP and 52% CACO. The solvent used in this set of examples and all the examples was a 90/10 ratio of water/$C_2H_5O(CH_2)_2OH$. Grade 24 heat-treated fused aluminum oxide grain was projected by electrostatic coating into the make coat with a weight of 1400 g/m$^2$. The resulting material was thermally precured for 90 minutes at 88° C. Then a size coat was applied over the abrasive grains with a weight of 570 g/m$^2$. The size coat consisted of a 78% solids blend of 48% RP and 52% CMS. The resulting product received a thermal precure at 88° C. for 90 minutes and a final thermal cure at 120° C. for 12 hours. Each disc was then flexed to uniformly and directionally crack the abrasive/adhesive coatings by passing the discs between weighted steel and rubber rollers and humidified for 3 days at 45% relative humidity prior to testing. Each disc was tested according to the Edge Shelling Test. The results can be found in Table 2. Note that mineral loss and steel cut is an average of about 5 discs per example.

EXAMPLES 17 THROUGH 28

The coated abrasives of Examples 17 through 28 were made in the same manner as Examples 1 through 12, respectively, except that a different make coat and size coat composition and precure were utilized. Additionally, the coated abrasives from Examples 17 through 28 were only tested using the Edge Shelling Test. The make coat was an 84% solids blend of 0.75% PH1, 21.6% BAM, 26.4% RP, and 52% CACO. The make coat precure consisted of exposing the make coat/abrasive grains to ultraviolet light three consecutive times at 4.6 meters per minute. The ultraviolet light was a Fusion "D" bulb with a focusing reflector which operated at 118 Watts/cm, and which is available from Fusion Systems, Rockville, Md.. The coated backings passed about 10 cm below the bulb at a rate of about 4.6 m/min. The number of passes (3 in this case) was determined as that necessary to cause sufficient degree of cure as to maintain the orientation of the abrasive grains, even under moderate deformation pressures. The examples received a final thermal cure as specified for Examples 1-16 above. The abrading results can be found in Table 2.

TABLE 2

| | Edge Shelling Test Results | |
|---|---|---|
| Example (g) | Mineral Loss (g) | Steel Cut |
| Control A | 1.8 | 114 |
| Control B | 2.4 | 174 |
| Control C | 2.5 | 192 |
| 1 | 3.6 | 166 |
| 2 | 5 | 154 |
| 3 | 2.6 | 147 |
| 4 | 4.7 | 151 |
| 5 | 4.3 | 169 |
| 6 | 2.1 | 142 |
| 7 | 3.5 | 141 |
| 8 | 1.9 | 129 |
| 9 | 2.2 | 141 |
| 10 | 3.2 | 137 |
| 11 | 7.6 | 159 |
| 12 | 3.7 | 169 |
| 13 | 4.3 | * |
| 14 | 2.8 | * |
| 15 | 1.5 | * |
| 16 | 2.5 | * |
| 17 | 3.3 | 164 |
| 18 | 3.2 | 149 |
| 19 | 4.6 | 177 |
| 20 | 4.3 | 175 |
| 21 | 4.6 | 193 |
| 22 | 4.7 | 169 |
| 23 | 4.8 | 167 |
| 24 | 2.9 | 151 |
| 25 | 3.6 | 177 |
| 26 | 4.3 | 166 |
| 27 | 6.2 | 204 |
| 28 | 4.0 | 176 |

* The amount of steel cut was not measured for these examples.

The results shown in Table 2 demonstrate that the thermoplastic backing successfully met the test criteria of mineral loss of no more than 6 grams and a steel cut of at least 125 grams. Also the BAM-containing adhesive layers of Examples 17-28 performed equal to or better than the adhesive layers of Examples 1-12 containing phenolic resin without BAM as determined by steel cut.

Samples of the coated abrasive discs for Examples 1-16 were also humidified for 3 weeks at 45% relative humidity, rather than the 3 days for the results presented in Table 2. The discs were then removed from the humidity cabinets and exposed to the ambient room conditions for one week. The discs were tested on the Slide Action Test III and the Angle Iron Test. The results are presented below in Tables 3 and 4, respectively. The cut, i.e., the amount of steel cut from the workpiece, was not measured on the Slide Action Test III. For the Angle Iron Test, the test was stopped after 8 minutes of grinding. Additionally, for the Angle Iron Test, the test was stopped at the first indication of a crack in the backing. In many instances these discs could continue to grind.

TABLE 3

| | Slide Action Test II | |
|---|---|---|
| Example | Time to Failure or Loss of Cut (minutes) | Comments |
| 1 | 3 | Cracks formed |
| 2 | 7 | Cracks formed |
| 3 | 3 | Cracks formed |
| 4 | 6 | Cracks formed |
| 5 | 15 | Cracks formed |
| 6 | 3 | Cracks formed |
| 7 | 5 | Cracks formed |
| 8 | 8 | Cracks formed |
| 9 | 4 | Cracks formed |
| 10 | 5 | Cracks formed |
| 11 | 12 | Cracks formed |
| 12 | 4 | Cracks formed |
| 13 | 9 | Cracks formed |
| 14 | 16 | Cracks formed |
| 15 | 14 | Cracks formed |
| 16 | 18 | Cracks formed |
| Control C | 4 | Stopped cutting |

TABLE 4

| | Angle Iron Test |
|---|---|
| Example | Time to Failure (minutes) |
| 1 | 6 |
| 2 | 5 |
| 3 | 6 |
| 4 | 4 |
| 5 | 8 |
| 6 | 6 |
| 7 | 4 |
| 8 | 5 |
| 9 | 6 |
| 10 | 4 |
| 11 | 8 |
| 12 | 6 |
| 13 | 8 |
| 14 | 8 |
| 15 | 8 |
| 16 | 8 |
| Control C | 2 |

The results in Table 3 indicate that while Control C demonstrated the longest time to failure, it provided no cut after 4 minutes of grinding in this severe test. Examples 1 through 16, however, continued to cut until they failed, most well beyond the 4 minutes. The results presented in Table 4 indicate that the abrasive articles of this invention perform substantially better than the control example when subjected to this test.

EXAMPLES 29 AND 30 AND CONTROL EXAMPLES D AND E

This set of examples compares the backing of the invention to conventional coated abrasive backings. The coated abrasives from these examples were tested according to the Edge Shelling Test, Angle Iron Test, and Slide Action Test I. The test results are an average of at least two discs. The test results are presented in Tables 5, 6, and 7.

EXAMPLE 29

The backing for this example was made according to the "General Procedure for Injection Molding the Backing." The backing consisted of 74.7% N6B, 20.0% EFG, 3.5% PPO66, and 1.8% SBS. The coated abrasive which contained this backing was made as follows. The make coat was applied to the top side of the backing with a weight of 206 g/m$^2$. The make consisted of an 84% solids blend of 26.4% RP, 21.6% BAM, 0.96% PH1, 18.2% CMS, and 33.8% CACO. Next, grade 50 heat treated fused aluminum oxide abrasive grain, which is available from Treibacher Chemische Werke, AG, Treibach, Austria, was electrostatically projected into the make coat with a weight of 618 g/m$^2$. The coated backings were passed about 10 cm below an ultraviolet Fusion "D" bulb that operated at 118 Watts/cm at a rate of 4.6 m/min. The number of passes (3 in this case) was determined as that necessary to cause a sufficient degree of cure so as to maintain the orientation of the abrasive grains, even under moderate deformation pressures. The examples received a final thermal cure as specified for Examples 1-16. Then a size coat was applied over the abrasive grains with a weight of 380 g/m$^2$. The size coat consisted of a 78% solids blend of 32% RP, 66% CRY, and 2% iron oxide, the latter of which was used for pigmentation. The resulting product received a thermal precure at 88° C. for 90 minutes and a final thermal cure at 120° C. for 12 hours. The disc was then flexed and humidified for 3 days at 45% relative humidity prior to testing.

EXAMPLE 30

The coated abrasive article for Example 30 was made and tested in the same manner as that for Example 29 except that the coated abrasive article was soaked for 24 hours in a bucket of room temperature water and then dried at room temperature prior to testing.

CONTROL EXAMPLE D

The coated abrasive article for Control Example D was made and tested in the same manner as that for Example 29 except that the backing was a conventional 0.84 mm thick vulcanized fiber backing, which is available from NVF Company, Yorklyn, Del..

CONTROL EXAMPLE E

The coated abrasive article for Control Example E was made and tested in the same manner as that for Example 30 except that a different thermoplastic backing was employed. The thermoplastic backing was made according to the "General Procedure for Injection Molding the Backing." The backing consisted essentially of only MFN6. There was no reinforcing fiber present in this backing.

TABLE 5

| Edge Shelling Test Results | | |
|---|---|---|
| Example | Mineral Loss (g) | Steel Cut (g) |
| 29 | 0.55 | 148 |
| 30 | 0.94 | 136 |
| Control D | 0.59 | 141 |
| Control E | 0.74 | 148 |

TABLE 6

| Angle Iron Test Results | |
|---|---|
| Example | Time to Failure* (minutes) |
| 29 | 15 |
| 30 | 17.5 |
| Control D | 7.25 |
| Control E | 2.25 |

*Note that if the time to failure was greater than about 15 minutes, the test was stopped. In these instances, the loss of structural integrity of the coated abrasive backing was not the "failure point."

TABLE 7

| Slide Action Test I | | |
|---|---|---|
| Example (minutes) | Total Cut (g) | Time to Failure |
| 29 | 285 | 20 |
| 30 | 175 | 12 |
| Control D | 270 | 20 |
| Control E | 109 | 5.25 |

These results indicate that the abrasive articles of this invention equal or exceed the performance of the control examples. Control Example E catastrophically failed, whereby several pieces of the disc were simultaneously lost, during the Angle Iron Test. Although Control Example E was made from mineral-filled nylon 6, there was no fibrous reinforcing material distributed throughout the backing.

EXAMPLES 31 THROUGH 33 AND CONTROL EXAMPLES F AND G

These examples compare various aspects of the invention to conventional backings. The coated abrasives made according to these examples were tested according to the Edge Shelling Test. The results are presented in Table 8.

EXAMPLE 31

The coated abrasive disc for Example 31 was made in the same manner as that for Example 29 except that a different abrasive grain was used. The abrasive grain was a grade 50 ceramic aluminum oxide made according to the teachings of U.S. Pat. No. 4,744,802 and U.S. 5,011,508, both of which are incorporated herein by reference.

EXAMPLE 32

The coated abrasive disc for Example 32 was made in the same manner as that for Example 31 except that the structural characteristics of the disc were different. The disc was 17.8 cm in diameter with a 2.2 cm diameter center hole. The disc had 180 ribs along the outer 3.2 cm projecting from the disc center at an angle of 50° to the radial direction (see FIG. 3).

EXAMPLE 33

The coated abrasive disc for Example 33 was made in the same manner as that for Example 32 except the backing composition was different. The backing consisted of 73.5% N6B, 20.7% EFG, 3.9% NTS, and 1.9% SBS.

CONTROL EXAMPLE F

The coated abrasive of Control Example F was a grade 50 "Regal" Resin Bond fiber disc commercially available from the 3M Company, St. Paul, Minn.

CONTROL EXAMPLE G

The coated abrasive disc for Control Example G was made in the same manner as that for Example 31 except that the backing was 0.84 mm thick vulcanized fiber backing, which is available from NVF Company, Yorklyn, Del.

TABLE 8

| | Edge Shelling Test Results | |
|---|---|---|
| Example (g) | Mineral Loss (g) | Steel Cut |
| 31 | 1.0 | 204 |
| 32 | 0.8 | 221 |
| 33 | 0.8 | 211 |
| Control F | 0.9 | 207 |
| Control G | 0.6 | 221 |

These results indicate that the abrasive articles of this invention easily meet the criteria of no more than 6 grams of mineral loss and at least 125 grams of steel.

EXAMPLES 34 THROUGH 36 AND CONTROL EXAMPLE H

These examples compare various aspects of the invention to conventional backings. The coated abrasive articles made according to these examples were tested according to the Slide Action Test II. The results are presented in Table 9.

EXAMPLE 34

The backing for Example 34 was made according to the "General Procedure for Injection Molding the Backing." The backing consisted of 80% N6B, 5% EFG, 12% PPO66, and 3% SBS. The remaining steps for making the coated abrasive articles were the same as those outlined in Examples 17–28.

EXAMPLE 35

The coated abrasive article for Example 35 was made in the same manner as that for Example 34 except that the backing consisted of 74.7% N6B, 20% EFG, 3.5% PPO66, and 1.8% SBS.

EXAMPLE 36

The coated abrasive article for Example 36 was made in the same manner as that for Example 34 except that the backing consisted of 54% N6B, 31% EFG, 12% PPO66, and 3% SBS.

CONTROL EXAMPLE H

The coated abrasive article of Control Example H included a grade 24 "Three-M-ite" Resin Bond fiber disc commercially available from the 3M Company, St. Paul, Minn.

TABLE 9

| | Slide Action Test II | |
|---|---|---|
| Example (minutes) | Total Cut (g) | Time to Failure |
| 34 | 165 | between 3 to 8 |
| 35 | 238 | 20 |
| 36 | 183 | 20 |

TABLE 9-continued

| | Slide Action Test II | |
|---|---|---|
| Example (minutes) | Total Cut (g) | Time to Failure |
| Control H | 124 | 4.5 (stopped cutting) |

These results indicate that the reinforcing fiber content is important to the proper performance of the backing for abrasive articles, with about 15–30% fiber in the backing being the most preferred. For Example 34, the backing failed in a shorter period of time than the other samples. The backing warped over the workpiece, snagged, and pieces from the backing flew apart. This is believed to be due to an insufficient amount of glass fiber reinforcement to withstand the severe conditions of this particular test. This does not necessarily mean that a backing with 1–5% fibrous reinforcing material could not be developed that would withstand the conditions of this test for a longer period of time. For Example 35, the disc survived the entire test, except that the backing deformed slightly. For Example 36, the disc survived the entire test, but there was some edge shelling.

EXAMPLES 37 THROUGH 42 AND CONTROL EXAMPLE I

This set of examples compares the tensile values of various backing constructions of the invention to a conventional vulcanized fiber backing. The tests were conducted at room temperature and 150° C. For Examples 37 through 42, the backings were made according to the "General Procedure for Injection Molding the Backing." The results are presented in Table 10.

EXAMPLE 37

The backing for this example consisted of 74.7% N6B, 20% EFG, 3.5% PPO66, and 1.8% SBS.

EXAMPLE 38

The backing for this example consisted of 74.7% N6B, 20% EFGL, 3.5% PPO66, and 1.8% SBS.

EXAMPLE 39

The backing for this example consisted of 74.7% N6B, 10% EFG, 10% EFGL, 3.5% PPO66, and 1.8% SBS.

EXAMPLE 40

The backing for this example consisted of 80% N6B, 5% EFG, 12% PPO66, and 3% SBS.

EXAMPLE 41

The backing for this example consisted of 75% N6B, 15% PPO66, and 10% SBS.

EXAMPLE 42

The backing for this example consisted of 54% N6B, 31% EFG, 12% PPO66, and 3% SBS. CONTROL EXAMPLE I The backing for this example was a conventional 0.84 mm thick vulcanized fiber, available from NVF Company, Yorklyn, Del.

TABLE 10

| Example | Type | Tensile Values: Tensile Value At Ambient Temperature (about 20° C.) (kg) | Tensile Value at Test Temperature of 150° C. (kg) |
|---|---|---|---|
| 37 | average | 153 | 53 |
| 37 | machine | 166 | 60 |
| 37 | cross | 138 | 52 |
| 38 | average | 149 | 48 |
| 39 | average | 139 | 47 |
| 40 | machine | 150 | 57 |
| 41 | machine | 111 | 39 |
| 42 | machine | 259 | 98 |
| 42 | cross | 211 | 70 |
| Control I | average | 186 | 64 |
| Control I | machine | 239 | 99 |
| Control I | cross | 133 | 57 |

The results listed are an average of at least three readings. All the samples displayed acceptable tensile strengths. All samples except Example 40 passed the criterion of having breaking strengths of at least 45.5 kg for 2.54 cm of width at 150° C. These results also indicate that there is less variation in tensile strength values with respect to backing orientation with the backings of this invention compared to the control example.

EXAMPLES 43 THROUGH 45

Examples 43 through 45 were prepared according to the "General Procedure for Injection Molding the Backing" and were of composition as described below. Abrasive coatings were applied as in Examples 1–16, except that Grade 50 "Cubitron" ceramic aluminum oxide grains (available from 3M, St. Paul, Minn.) were used. Slide Action Test I was modified for these examples to employ 1018 mild steel as the workpiece, and was run for 20 minutes. The Angle Iron Test was extended to run for 20 minutes. The test results for these examples are shown in Table 11.

EXAMPLE 43

The backing for this example consisted of 100% N6B. There was no toughening agent or reinforcing fiber present.

EXAMPLE 44

The backing for this example consisted of 85% N6B and 15% EFG. No toughening agent was used.

EXAMPLE 45

The backing for this example consisted of 80% N6B and 20% EFG. No toughening agent was used.

TABLE 11

| Angle Example failure | Gardner Impact (Joules for 0.89 mm Thickness) | Edge Shelling Test: Cut (g) | Edge Shelling Test: Mineral Loss (g) | Slide Action Test I (cut in g per 20 min) | Iron Test (time to |
|---|---|---|---|---|---|
| 43 min | 9.0+ | 209 | 1.2 | failed | 20 |
| 44 min | 0.4 | 210 | 1.1 | @9 min 956 | 20 |
| 45 min | 1.6 | 206 | 1.0 | 797 | 20 |

These results indicate that improved and advantageous backings can be prepared without a toughening agent, although a toughening agent is preferred. These data also further demonstrate the benefits of the fibrous reinforcing material in that it imparts heat and pressure resistance necessary to make an acceptable abrasive backing, even though the toughness is less than it would be with a toughening agent. Further, the data demonstrate the superior performance of the backing with state-of-the-art abrasive grains (relative to previous examples).

EXAMPLES 46 AND 47 AND CONTROL EXAMPLES J AND K

This set of examples illustrates characteristics of backings of the present invention made using rubber-polyamide copolymer toughening agents. These toughening agents are available from DuPont under the trade designation "Zytel." The toughening agents used in these examples are "Zytel" FN resins, which are flexible nylon alloys. They are graft copolymers of functionalized polyamide grafted to functionalized acrylic rubber. For examples 46 and 47, the backings were made according to the "General Procedure for Injection Molding the Backing." Abrasive coatings were applied to Examples 46, 47, Control J, and Control K as in Examples 43–45. The results are presented in Table 12.

EXAMPLE 46

The backing for this example consisted of 71.3% N6B, 20% EFG, and 8.7% "Zytel" FN 726 toughening agent.

EXAMPLE 47

The backing for this example consisted of 71.5% N6B, 20% EFG, and 8.5% "Zytel" FN 718 toughening agent.

CONTROL EXAMPLE J

The backing for this example was a conventional 0.84 mm thick vulcanized fiber, available from NYF Company, Yorklyn, Del.

CONTROL EXAMPLE K

The backing for this example was a grade 50 "Regal" NF vulcanized fiber disc, available from the 3M Company, St. Paul, Minn.

TABLE 12

| Example failure) | Gardner Impact (Joules for 0.89 mm Thickness) | Flexural Modulus kg/cm$^2$ | Edge Shelling Test: Cut (g) | Edge Shelling Test: Mineral Loss (g) | Slide Action Test I (cut in g per 20 min) | Angle Iron Test (time to |
|---|---|---|---|---|---|---|
| 46 | 2.9 | 43,000 | 205 | 1.4 | 839 | 20 min |
| 47 | 3.0 | 40,000 | 206 | 1.2 | 937 | 20 min |
| Control J min* | — | — | 217 | 1.1 | 658 | 20 |
| Control K min | — | — | 202 | 0.9 | 638 | failed @5 |

*This sample experienced extended humidity conditioning. Normally, this composition would fail as in Control Example K.

The invention has been described with reference to various specific and preferred embodiments and techniques. It should be understood, however, that many variations and modifications can be made while remaining within the spirit and scope of the invention.

What is claimed is:

1. A coated abrasive backing devoid of abrasive particles and having a working surface adapted to receive an abrasive coating comprising abrasive particles, the backing comprising:

(a) a tough, heat resistant, thermoplastic binder material present in an amount of about 60 to about 99-wt% based upon the weight of the backing; and (b) an effective amount of a fibrous reinforcing material imparting stiffness, shape control and heat resistance to said backing is distributed throughout the tough, heat resistant, thermoplastic binder material; wherein the tough, heat resistant, thermoplastic binder material and fibrous reinforcing material together comprise a hardened composition that will not substantially deform or disintegrate under abrading conditions of at least 200° C. and at least 7 kg/cm$^2$ at the abrading interface during grinding and at least in portions of the backing having the abrasive particles attached thereto, the hardened composition defining the working surface.

2. The coated abrasive backing of claim 1 wherein the hardened composition has a void volume of less than about 0.10%.

3. The coated abrasive backing of claim 2 wherein:

(a) the tough, heat resistant, thermoplastic binder material has a melting point of at least about 200° C.; and (b) the fibrous reinforcing material is in the form of individual fibers with a melting point at least about 25° C. above the melting point of the tough, heat resistant, thermoplastic binder material.

4. The coated abrasive backing of claim 3 wherein the fibers are glass fibers.

5. The coated abrasive backing of claim 1 wherein the backing further includes an effective amount of a toughening agent therein imparting impact and grinding properties to said backing.

6. The coated abrasive backing of claim 5 wherein the toughening agent is a rubber toughener or a plasticizer.

7. The coated abrasive backing of claim 5 wherein the toughening agent is selected from the group consisting of toluenesulfonamide derivatives, styrene butadiene copolymers, polyether backbone polyamides, rubber-polyamide copolymers, triblock polymers of styrene-(ethylene butylene)-styrene, and mixtures thereof.

8. The coated abrasive backing of claim 7 wherein the toughening agent is a rubber-polyamide copolymer or a styrene-(ethylene butylene)-styrene triblock polymer.

9. The coated abrasive backing of claim 8 wherein the toughening agent is a rubber-polyamide copolymer.

10. The coated abrasive backing of claim 1 wherein the hardened composition of the tough, heat resistant, thermoplastic binder material and the fibrous reinforcing material is flexible.

11. The coated abrasive backing of claim 10 wherein the hardened composition of the binder and the fibrous reinforcing material possesses a flexural modulus of between about 17,500 kg/cm$^2$ and about 141,000 kg/cm$^2$, under ambient conditions.

12. The coated abrasive backing of claim 1 wherein the thermoplastic binder material is selected from the group consisting of polycarbonates, polyetherimides, polyesters, polysulfones, polystyrenes, acrylonitrile-butadiene-styrene block copolymers, acetal polymers, polyamides, and combinations thereof.

13. The coated abrasive backing of claim 1 further including a molded-in attachment system which has the same composition as the backing.

14. The coated abrasive backing of claim 13 wherein the backing is in the shape of a disc and the attachment system is located in the center of the disc.

15. A coated abrasive backing devoid of abrasive particles and having a working surface adapted to receive an abrasive coating comprising abrasive particles, the backing comprising:

(a) about 60–99 wt-% of a tough, heat resistant thermoplastic binder material, based upon the weight of the backing, with a melting point of at least about 200° C.; and (b) an effective amount of a fibrous reinforcing material imparting stiffness, shape control and heat resistance to said backing is distributed throughout the thermoplastic binder material; wherein said thermoplastic binder material and fibrous reinforcing material together comprise a flexible hardened composition that will not substantially deform or disintegrate under abrading conditions of at least 200° C. and at least 7 kg/cm$^2$ at the abrading interface during grinding and at least in portions of the backing having the abrasive particles attached thereto, the hardened composition defining the working surface.

16. The coated abrasive backing of claim 15 wherein the thermoplastic binder material is selected from the group consisting of polycarbonates, polyetherimides, polyesters, polysulfones, polystyrenes, acrylonitrile-butadiene-styrene block copolymers, acetal polymers, polyamides, and combinations thereof.

17. The coated abrasive backing of claim 15 comprising an effective amount of a toughening agent therein imparting impact and grinding properties to said backing.

18. A coated abrasive article comprising:

(a) a backing having a working surface and a back surface, the working surface and the back surface devoid of abrasive particles, the working surface adapted to receive an abrasive coating comprising abrasive particles; wherein the backing comprises:

(i) about 60–99 wt-% of a tough, heat resistant thermoplastic binder material based upon the total weight of the backing;

(ii) an effective amount of a fibrous reinforcing material imparting stiffness, shape control and heat resistance to said backing is; and (iii) about 1–30 wt-% of a toughening agent based upon the total weight of the backing; wherein the thermoplastic binder material, fibrous reinforcing material, and toughening agent define a hardened mixture that will not substantially deform or disintegrate under abrading conditions of at least 200° C. and at least 7 kg/cm$^2$ at the abrading interface during grinding and at least in portions of the backing having the abrasive particles attached thereto, the hardened mixture defining the working surface;

(b) a first adhesive layer applied to the working surface of the backing;

(c) an abrasive material embedded into the first adhesive layer; and (d) a second adhesive layer applied to the abrasive material and first adhesive layer.

19. The coated abrasive article of claim 18 wherein the back surface of the backing has ribs molded therein.

20. The coated abrasive backing of claim 19 wherein the ribs are molded into the back surface of the backing in a radial pattern.

21. The coated abrasive article of claim 18 wherein the fibrous reinforcing material is in the form of individual fibers distributed substantially uniformly throughout the thermoplastic binder material.

22. The coated abrasive article of claim 18 wherein the fibrous reinforcing material is in the form of a mat structure.

23. The coated abrasive article of claim 18 wherein the backing has an edge region and a center region; said edge region being of increased thickness relative to said center region.

* * * * *

UNITED STATES PATENT AND TRADEMARK OFFICE

CERTIFICATE OF CORRECTION

PATENT NO. : 5,316,812

DATED : May 31, 1994

INVENTOR(S) : George M. Stout, James G. Homan, John R. Mlinar, and Larry R. Wright It is certified that error appears in the above-indentified patent and that said Letters Patent is hereby corrected as shown below:

Title page under "References Cited", please list the following U.S. Patent Documents:

| | | | |
|---|---|---|---|
| -- 289,879 | 12/1883 | Almond | 51/392 |
| 2,032,356 | 03/1936 | Ellis | 51/278 |
| 2,349,365 | 05/1944 | Martin | 51/197 |
| 2,404,207 | 07/1946 | Ball | 51/188 |
| 2,411,724 | 11/1946 | Hill | 51/293 |
| 2,712,987 | 07/1955 | Storrs | 51/293 |
| 2,983,637 | 05/1961 | Schmidt | 154/52.1 |
| 2,999,780 | 09/1961 | Perrault | 154/83 |
| 3,030,743 | 04/1962 | Raymond | 51/207 |
| 3,166,388 | 01/1965 | Riegger | 51/296 |
| 3,561,938 | 02/1971 | Block | 51/358 |
| 3,562,968 | 02/1971 | Johnson | 51/389 |
| 3,860,400 | 01/1975 | Prowse | 51/295 |
| 4,253,836 | 03/1981 | Miranti | 474/200 |
| 4,256,467 | 03/1981 | Gorsuch | 51/295 |
| 4,314,827 | 02/1982 | Leitheiser | 51/298 |
| 4,525,177 | 06/1985 | Grimes | 51/295 |
| 4,554,765 | 11/1985 | Grimes | 51/401 |
| 4,609,581 | 09/1986 | Ott | 428/100 |
| 4,652,274 | 03/1987 | Boettcher | 51/298 |
| 4,653,236 | 03/1987 | Grimes | 51/401 |
| 4,744,802 | 05/1988 | Schwabel | 51/309 |
| 4,770,671 | 09/1988 | Monroe | 51/293 |

UNITED STATES PATENT AND TRADEMARK OFFICE

CERTIFICATE OF CORRECTION

PATENT NO. : 5,316,812

DATED : May 31, 1994

INVENTOR(S) : George M. Stout, James G. Homan, John R. Mlinar, and Larry R. Wright It is certified that error appears in the above-indentified patent and that said Letters Patent is hereby corrected as shown below:

| | | | |
|---|---|---|---|
| 4,867,760 | 09/1989 | Yarbrough | 51/298 |
| 4,894,280 | 01/1990 | Guthrie | 428/224 |
| 4,903,440 | 02/1990 | Larson | 51/298 |
| 4,906,523 | 03/1990 | Bilkadi | 428/327 |
| 5,011,508 | 04/1991 | Wald | 51/293-- |

Page 1, under "References Cited", please list the following Foreign Patent Documents:

--GB 1,240,289 (published July 21, 1971)
GB 1,445,520 (published August 11, 1976)
CA 1,023,563 (issued January 3, 1978)
WO 86/02306 (published April 24, 1986)
EPO 0 340 982 A2 (published November 8, 1989)
FR 2,396,625 (published February 2, 1979)
GB 2,240,736 A (published August 14, 1991)--

Page 1, under "References Cited", please list the following Other Publications:

--ME, November 1990.
ASTM D 3029-84, pagees 749, 764.
ASTM D 256-84, pages 81-102.
ASTM D 790-86, pages 384-397.
American National Standard for Grading of Certain Abrasive Grain on Coated Abrasive Material", approved January 27, 1984, sponsored by Grinding Wheel Institute.--

UNITED STATES PATENT AND TRADEMARK OFFICE

CERTIFICATE OF CORRECTION

PATENT NO. : 5,316,812

DATED : May 31, 1994

INVENTOR(S) : George M. Stout, James G. Homan, John R. Mlinar, and Larry R. Wright It is certified that error appears in the above-indentified patent and that said Letters Patent is hereby corrected as shown below:

Col. 6, line 11, delete "disc 3" and insert --disc 31--.

Col. 6, line 20, delete "3" and insert --33--.

Col. 24, line 57, before "side" insert --correct--.

Col. 26, Table 3, delete "II" and insert --III--.

Col. 30, line 64, delete "CONTROL".

Col. 30, line 65, before "EXAMPLE I" insert --CONTROL--.

Signed and Sealed this

Thirteenth Day of June, 1995

*Attest:*

Bruce Lehman

BRUCE LEHMAN

*Attesting Officer*

*Commissioner of Patents and Trademarks*